US010881567B2

(12) United States Patent
St. John et al.

(10) Patent No.: US 10,881,567 B2
(45) Date of Patent: Jan. 5, 2021

(54) PATIENT SUPPORT APPARATUS

(71) Applicant: Stryker Corporation, Kalamazoo, MI (US)

(72) Inventors: Connor F. St. John, Kalamazoo, MI (US); Cory P. Herbst, Shelbyville, MI (US)

(73) Assignee: Stryker Corporation, Kalamazoo, MI (US)

( * ) Notice: Subject to any disclaimer, the term of this patent is extended or adjusted under 35 U.S.C. 154(b) by 238 days.

(21) Appl. No.: 15/795,695

(22) Filed: Oct. 27, 2017

(65) Prior Publication Data

US 2018/0116885 A1 May 3, 2018

Related U.S. Application Data

(60) Provisional application No. 62/414,200, filed on Oct. 28, 2016.

(51) Int. Cl.
*A61G 7/015* (2006.01)
*A61G 7/008* (2006.01)
(Continued)

(52) U.S. Cl.
CPC ..... *A61G 7/015* (2013.01); *A61G 7/005* (2013.01); *A61G 7/008* (2013.01); *A61G 7/012* (2013.01); *A61G 7/018* (2013.01)

(58) Field of Classification Search
CPC ..... A61G 7/001; A61G 7/005; A61G 7/008; A61G 7/012; A61G 7/015; A61G 13/018;
(Continued)

(56) References Cited

U.S. PATENT DOCUMENTS 2,271,201 A 1/1942 Otto
4,225,988 A 10/1980 Cary et al.
(Continued)

FOREIGN PATENT DOCUMENTS

CA 2696686 A1 4/2009
DE 8304560 U1 6/1983
(Continued)

OTHER PUBLICATIONS

English language abstract and machine-assisted English translation for DE 83 04 560 extracted from espacenet.com database on May 10, 2018, 16 pages.
(Continued)

*Primary Examiner* — Robert G Santos
*Assistant Examiner* — Alison N Labarge
(74) *Attorney, Agent, or Firm* — Howard & Howard Attorneys PLLC

(57) ABSTRACT

A patient support apparatus for supporting a patient. A pair of support decks are operatively attached to a support frame. Each of the support decks is arranged for articulation about a respective longitudinal axis between a plurality of longitudinal support configurations. Each of the support decks comprises a seat section and an auxiliary section operatively attached to the seat section for articulation transverse to the respective longitudinal axis. A joint assembly is coupled to the support frame and to each of the support decks. The joint assembly is arranged to concurrently position the auxiliary sections at a common angle relative to the respective seat sections independent of articulation of the support decks between the longitudinal support configurations.

20 Claims, 19 Drawing Sheets

(51) Int. Cl.
*A61G 7/005* (2006.01)
*A61G 7/018* (2006.01)
*A61G 7/012* (2006.01)

(58) Field of Classification Search
CPC ..... A61G 13/08; A61G 7/018; A61G 13/02; A61G 15/005; F16D 2125/587; F16D 2125/005; F16C 11/02; F16C 11/06
See application file for complete search history.

(56) References Cited

U.S. PATENT DOCUMENTS

| | | | |
|---|---|---|---|
| 4,375,706 | A | 3/1983 | Finnhult |
| 5,224,228 | A | 7/1993 | Larrimore |
| 5,443,439 | A | 8/1995 | Ohshita |
| 5,513,406 | A | 5/1996 | Foster et al. |
| 5,535,464 | A | 7/1996 | Salonica |
| 5,806,115 | A | 9/1998 | Brown |
| 5,826,286 | A | 10/1998 | Cranston |
| 6,276,012 | B2 | 8/2001 | Borders |
| 6,654,974 | B2 | 12/2003 | Ruehl et al. |
| 7,246,389 | B2 | 7/2007 | Taguchi et al. |
| 7,549,661 | B2 | 6/2009 | Jackson et al. |
| 7,716,762 | B2 | 5/2010 | Ferraresi et al. |
| 7,761,942 | B2 | 7/2010 | Benzo et al. |
| 7,886,379 | B2 | 2/2011 | Benzo et al. |
| 8,826,475 | B2 | 9/2014 | Jackson |
| 9,216,123 | B2 | 12/2015 | Tekulve |
| 2003/0115672 | A1* | 6/2003 | Newkirk ..... A61G 7/015 5/600 |
| 2005/0160530 | A1 | 7/2005 | Taguchi et al. |
| 2006/0085913 | A1* | 4/2006 | Kawakami ..... A47C 19/045 5/618 |
| 2009/0094745 | A1 | 4/2009 | Benzo et al. |
| 2010/0222724 | A1* | 9/2010 | Huang ..... A61G 7/0573 601/115 |
| 2013/0254992 | A1* | 10/2013 | Jackson ..... A61G 7/001 5/607 |
| 2016/0022039 | A1 | 1/2016 | Paul et al. |

FOREIGN PATENT DOCUMENTS

| | | | |
|---|---|---|---|
| EP | 0030035 | A1 | 6/1981 |
| EP | 262771 | A1 | 4/1988 |
| EP | 0363541 | A1 | 4/1990 |
| EP | 2308441 | A1 | 4/2011 |
| GB | 2345439 | A | 7/2000 |

OTHER PUBLICATIONS

Machine-Assisted English language abstract for EP 0 030 035 extracted from espacenet.com database on May 10, 2018, 1 page.
INKBED, "Brand New Model InkBed Patented Fully Adjustable Tattoo Table & Bed Webpage", http://www.inkbed.com/brand-new-model-inkbed-patented-fully-adjustable-tattoo-table-bed/, 2019, 3 pages.

* cited by examiner

PATIENT SUPPORT APPARATUS

CROSS-REFERENCE TO RELATED APPLICATION

The subject patent application claims priority to and all the benefits of U.S. Provisional Patent Application Ser. No. 62/414,200 filed on Oct. 28, 2016, the disclosure of which is hereby incorporated by reference.

BACKGROUND

Patient support apparatuses, such as hospital beds, stretchers, cots, tables, and wheelchairs, facilitate care of patients in a health care setting. Conventional patient support apparatuses generally comprise a base, a support frame, a patient support deck operatively attached to the support frame, an intermediate assembly for lifting and lowering the support frame relative to the base, and actuators arranged to move one or more sections of the patient support deck relative to the support frame Certain conventional patient support apparatuses, such as those realized as hospital beds, are primarily employed to provide support to a patient lying on the patient support deck. To that end, one or more sections of the patient support deck provide support to the patient's head, torso, legs, and feet, allowing the patient to lay on their side, on their back in a supine position, and the like. In addition, one or more sections of the patient support deck can typically be moved or oriented so as to promote patient comfort and to help facilitate patient mobility. By way of example, the patient support deck may be movable into a fowler's position to allow the patient to lay upright.

In order to position the patient, the support deck typically pivots so as to raise or lower the patient's feet relative to the patient's head. As such, the patient may be restricted to laying in a limited number of positions or orientations, such as flat on their back or their side. While certain patient support apparatuses known in the related art are configured to position the patient in other positions and orientations, such patient support apparatuses tend to afford only limited range of positioning of the patient and/or may necessarily be unable to orient certain sections of the patient support deck as a result of the relative position of other sections of the patient support deck. As such, conventional patient support apparatuses of this type tend to be expensive to manufacture, complicated to use, and may prevent a caregiver from efficiently caring for the patient.

Accordingly, there remains a need in the art for a patient support apparatus which overcomes the disadvantages in the prior art.

BRIEF DESCRIPTION OF THE DRAWINGS

Advantages of the present invention will be readily appreciated as the same becomes better understood by reference to the following detailed description when considered in connection with the accompanying drawings.

DETAILED DESCRIPTION

Figure 1:
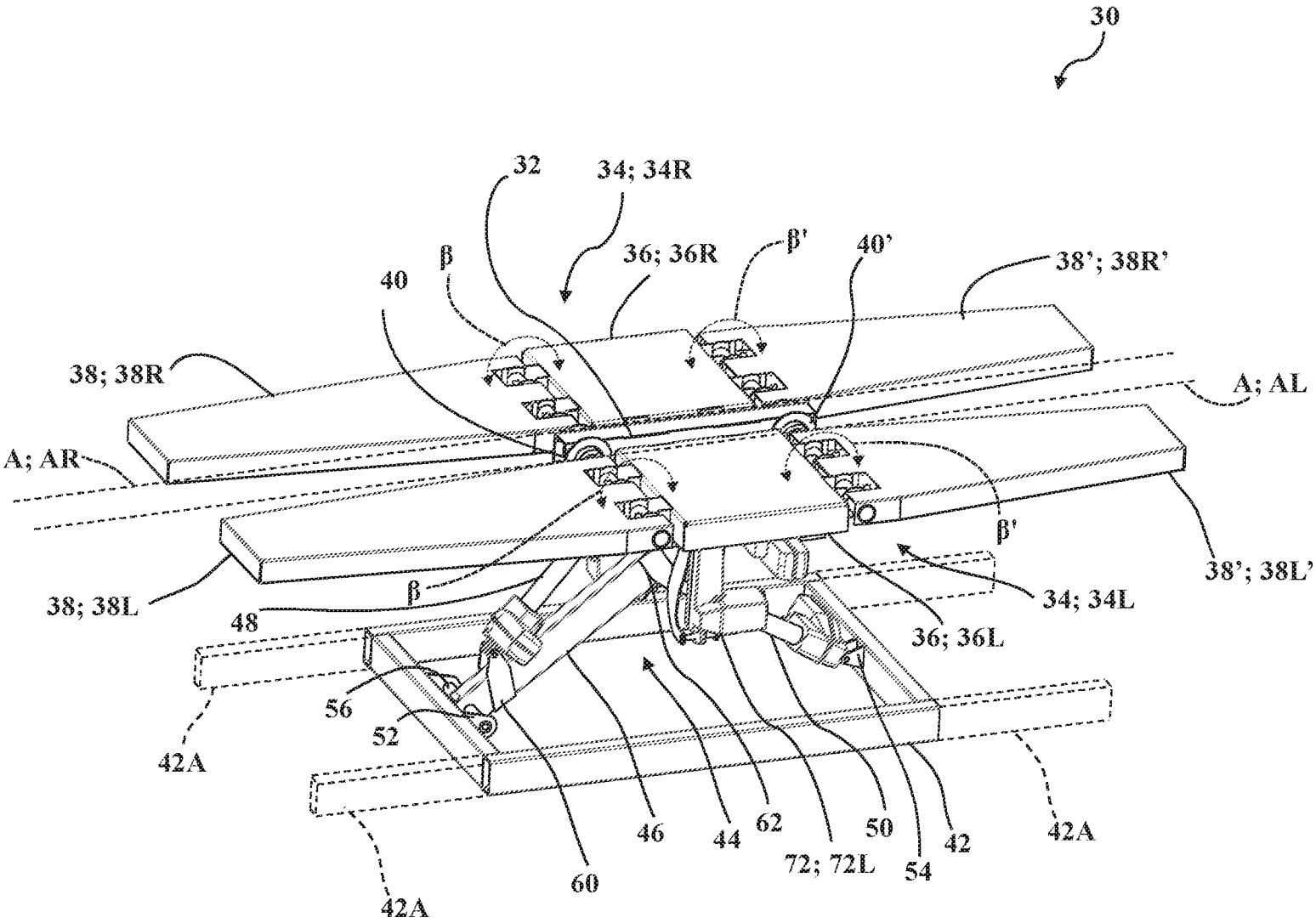
FIG. 1 is a perspective view of a patient support apparatus having a pair of support decks operatively attached to a support frame and supported by an intermediate assembly.

Referring now to FIG. 1, a patient support apparatus 30 is shown for supporting a patient in a health care setting. The patient support apparatus 30 comprises a support frame 32 and a pair of support decks 34 operatively attached to the support frame 32. The support decks 34 are each arranged for articulation about a respective longitudinal axis A between a plurality of longitudinal support configurations, as described in greater detail below. Each of the support decks 34 comprises a seat section 36 and an auxiliary section 38 operatively attached to the seat section 36 for articulation about an axis transverse to the respective longitudinal axis A. The patient support apparatus 30 further comprises joint assemblies 40 coupled to the support frame 32 and to each of the support decks 34. One of the joint assemblies 40 are arranged to concurrently position the auxiliary sections 38 at a common angle β relative to the respective seat sections 36 and independent of articulation of the support decks 34 between the longitudinal support configurations. The support frame 32, support decks 34, seat sections 36, auxiliary sections 38, and joint assemblies 40 of the patient support apparatus 30 will each be described in greater detail below.

Referring now to FIGS. 1-2 and 8-10, in one embodiment, the patient support apparatus 30 further comprises a base 42 and an intermediate assembly 44 which cooperate to effect adjustable lowering/raising of the support frame 32 and the support decks 34 relative to a floor of a healthcare facility, as described in greater detail below. The base 42 supports both the intermediate assembly 44 and the support frame 32 and is adapted to be mounted to or positioned along the floor. The base 42 may be stationary or may comprise wheels (not shown) to facilitate movement of the patient support apparatus 30 along the floor. In some embodiments the base 42 may comprise one or more extensions 42A to provide added stability. The intermediate assembly 44 is interposed between the base 42 and the support frame 32 and is configured to effect movement of the support frame 32 relative to the base 42. To this end, the intermediate assembly 44 comprises an intermediate brace 46, a first lift actuator 48, and a second lift actuator 50.

As is shown best in FIGS. 1, 2, 5, and 11B, the intermediate brace 46 is coupled to the base 42 and to the support frame 32, the first lift actuator 48 is interposed in force-translating relationship between the intermediate brace 46 and the support frame 32, and the second lift actuator 50 is interposed in force-translating relationship between the intermediate brace 46 and the base 42. To this end, the base 42 has a first base mount 52 and a second base mount 54; the intermediate brace 46 has a first intermediate mount 56, a second intermediate mount 58, a first actuator mount 60, and a second actuator mount 62; and the support frame 32 has a first frame mount 64 and a second frame mount 66.

Figure 2:
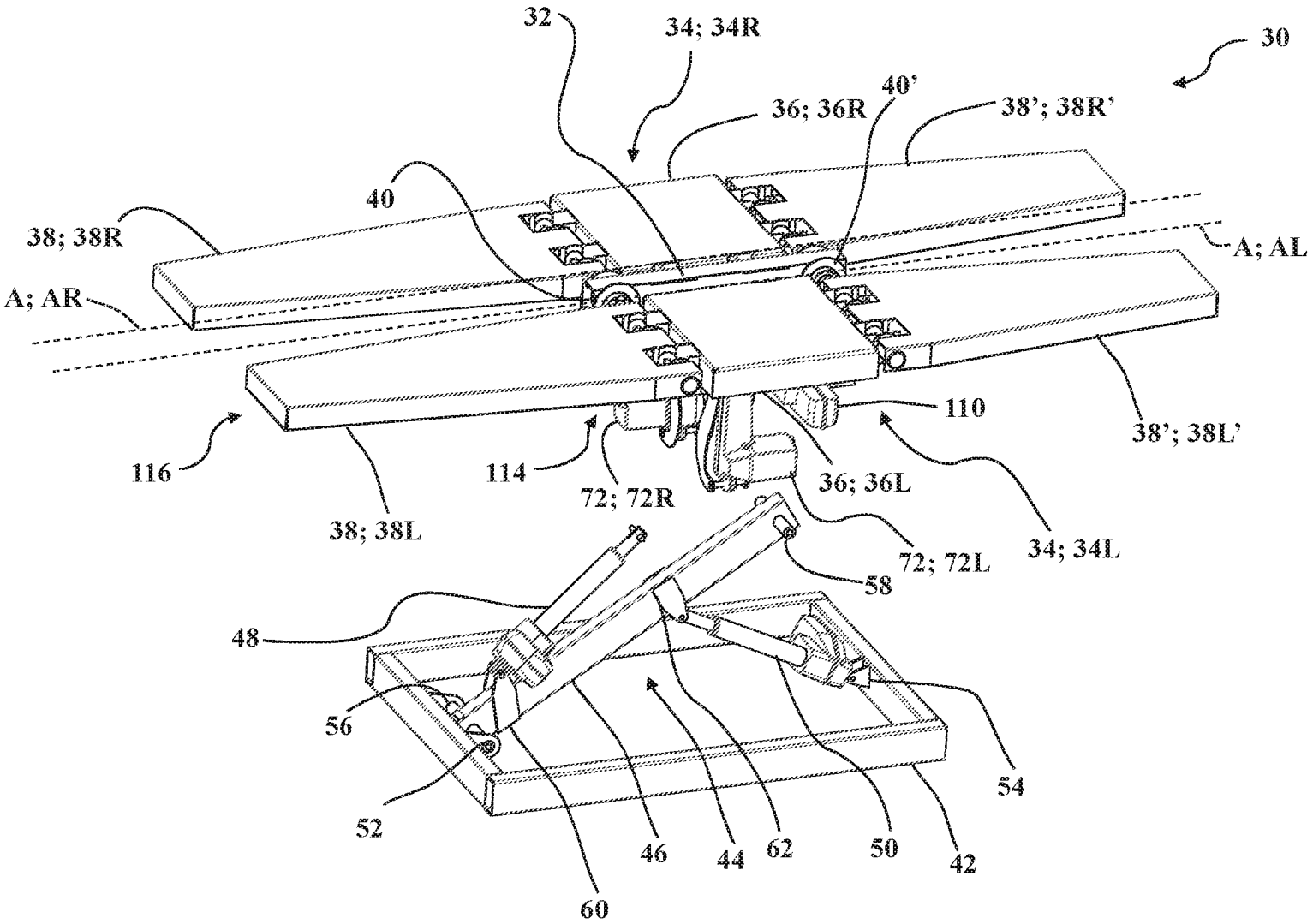
FIG. 2 is an exploded perspective view of the patient support apparatus of FIG. 1 with the support frame and the support decks shown spaced from the intermediate assembly.

As is shown best in FIG. 2, the first actuator mount 60 of the intermediate brace 46 is arranged between the first intermediate mount 56 and the second actuator mount 62, and the second actuator mount 62 is arranged between the first actuator mount 60 and the second intermediate mount 58. The first intermediate mount 56 of the intermediate brace 46 is pivotally attached to the first base mount 52 of the base 42, and the second intermediate mount 58 of the intermediate brace 46 is pivotally attached to the second frame mount 66 of the support frame 32. The first lift actuator 48 is pivotally attached to both the first actuator mount 60 of the intermediate brace 46 and to the first frame mount 64 of the support frame 32 and, similarly, the second lift actuator 50 is pivotally attached to both the second base mount 54 of the base 42 and to the second actuator mount 62 of the intermediate brace 46 (see FIGS. 2, 5, and 11B). With this configuration, the first lift actuator 48 is arranged to move the support frame 32 relative to the intermediate brace 46, and the second lift actuator 50 is arranged to move the intermediate brace 46 relative to the base 42. Thus, the second lift actuator 50 cooperates with the first lift actuator 48 to effect articulated movement of the support frame 32 relative to the base 42. Advantageously, the first lift actuator 48 and the second lift actuator 50 are arranged and configured to facilitate raising and lowering of the support frame 32 and support decks 34 relative to the base 42 (compare FIGS. 1 and 8), as well as to facilitate positioning the support decks 34 to accommodate different patient positions, as is described in greater detail below (compare FIGS. 8, 9, and 10).

As noted above, the pair of support decks 34 are operatively attached to the support frame 32 and cooperate to provide support to the patient when lying or seated. In the representative embodiment illustrated in FIGS. 1-13C, the support decks 34 generally correspond to respective left and right sides of the patient's body such that the pair of support decks 34 are further defined as a left support deck 34L and a right support deck 34R. For the purposes of clarity and consistency throughout the drawings and in the description which follows, components and structural features which correspond to or are otherwise associated with the left support deck 34L may be designated with the suffix "L", and components or structural features which correspond to or are otherwise associated with the right support deck 34R may be designated with the suffix "R". By way of illustrative example, the left support deck 34L is arranged for articulation about a left longitudinal axis AL and comprises a left seat section 36L and a left auxiliary section 38L, and the right support deck 34R is arranged for articulation about a right longitudinal axis AR and comprises a right seat section 36R and a right auxiliary section 38R. Those having ordinary skill in the art will appreciate that the use of suffixes herein is exemplary, non-limiting, and interchangeable according any suitable nomenclature. Moreover, in the description which follows, the use of suffixes may be omitted in connection with additional description of certain previously-introduced pairs of corresponding components and structural features.

Figure 4:
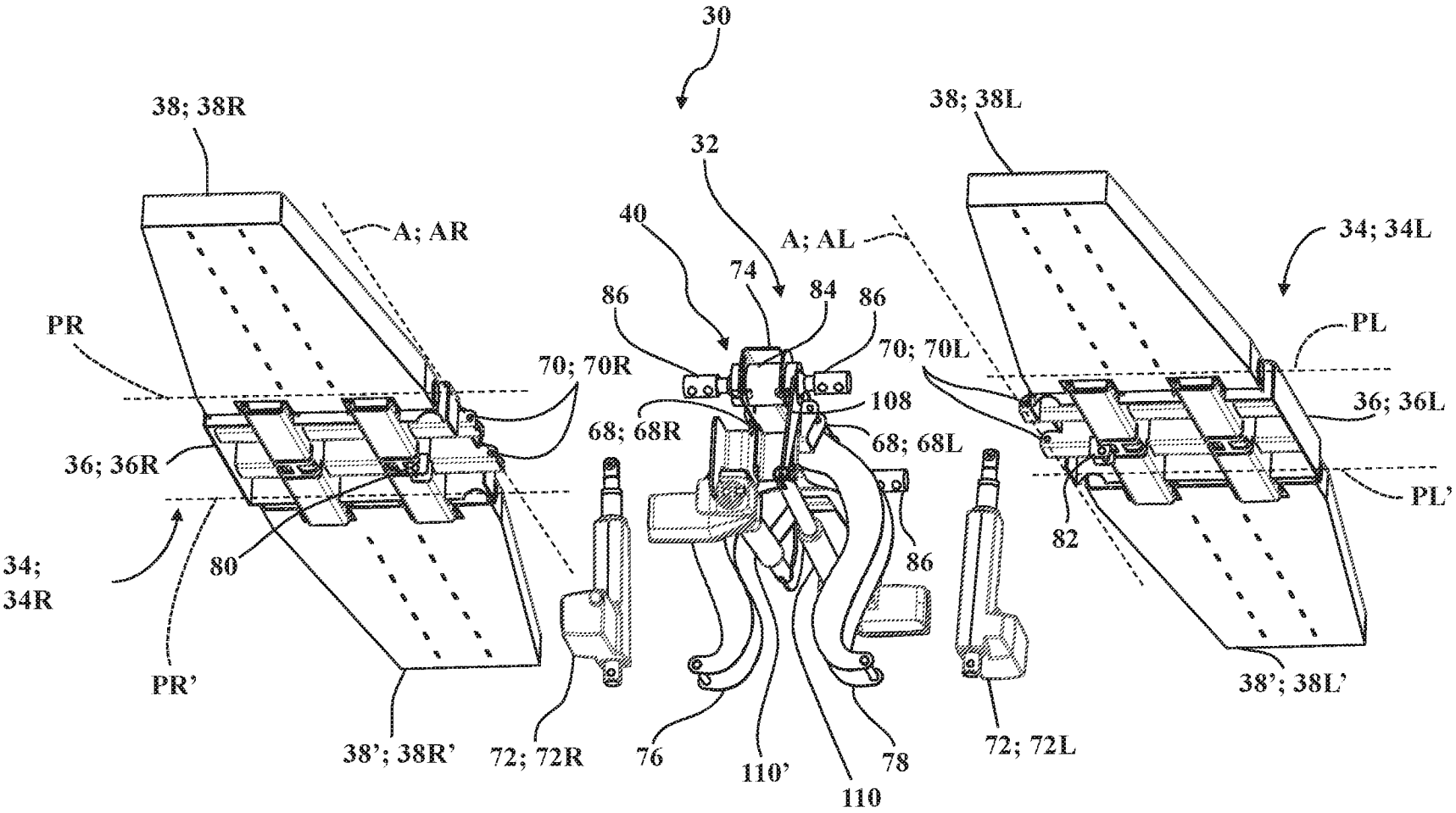
FIG. 4 is an exploded perspective view of the patient support apparatus of FIG. 3 with the support decks shown spaced from the support frame and the deck actuators.
Figure 5:
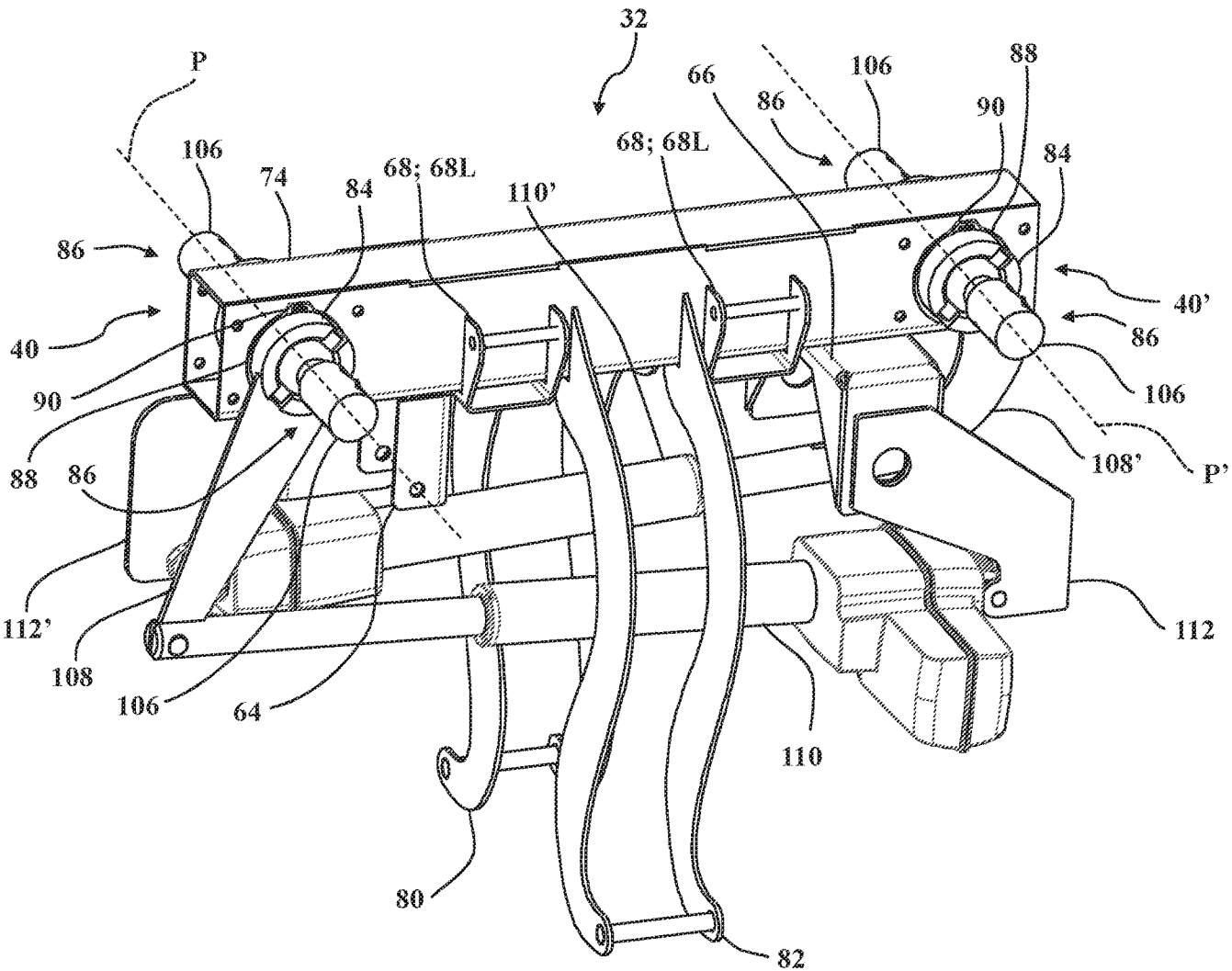
FIG. 5 is a perspective view of the support frame of the patient support apparatus of FIG. 4 showing a pair of joint assemblies and a pair of auxiliary actuators.

As noted above, the support decks 34L, 34R are each arranged for articulation about the respective longitudinal axes AL, AR between a plurality of longitudinal support configurations. To this end, and as best shown in FIGS. 4 and 5, the support frame 32 has frame hinge mounts 68 and the support decks 34 each have deck hinge mounts 70 which rotatably engage one of the frame hinge mounts 68 so as to facilitate articulation of the support decks 34 about the respective longitudinal axes A. Specifically, in the representative embodiment illustrated herein, the support frame 32 has a pair of left frame hinge mounts 68L which pivotally engage a corresponding pair of left deck hinge mounts 70L operatively attached to the left seat section 36L, as well as a pair of right frame hinge mounts 68R which pivotally engage a corresponding pair of right deck hinge mounts 70R operatively attached to the right seat section 36R. Here, pivotal engagement of the left frame hinge mounts 68L with the left deck hinge mounts 70L defines the left longitudinal axis AL, and pivotal engagement of the right frame hinge mounts 68R with the right deck hinge mounts 70R defines the right longitudinal axis AR. It will be appreciated that the frame hinge mounts 68 and/or the deck hinge mounts 70 could be configured or arranged in any suitable way sufficient to facilitate articulation of the support decks 34 with respect to the support frame 32.

In the representative embodiment illustrated herein, the left longitudinal axis AL and the right longitudinal axis AR are parallel and are spaced from each other. However, those having ordinary skill in the art will appreciate that the longitudinal axes AL, AR could be arranged in a non-parallel fashion. Similarly, it will be appreciated that the longitudinal axes AL, AR may be spaced from each other at any suitable distance, or may be aligned with each other so as to be coincident such that the support decks 34 could articulate about a common longitudinal axis.

Figure 3:
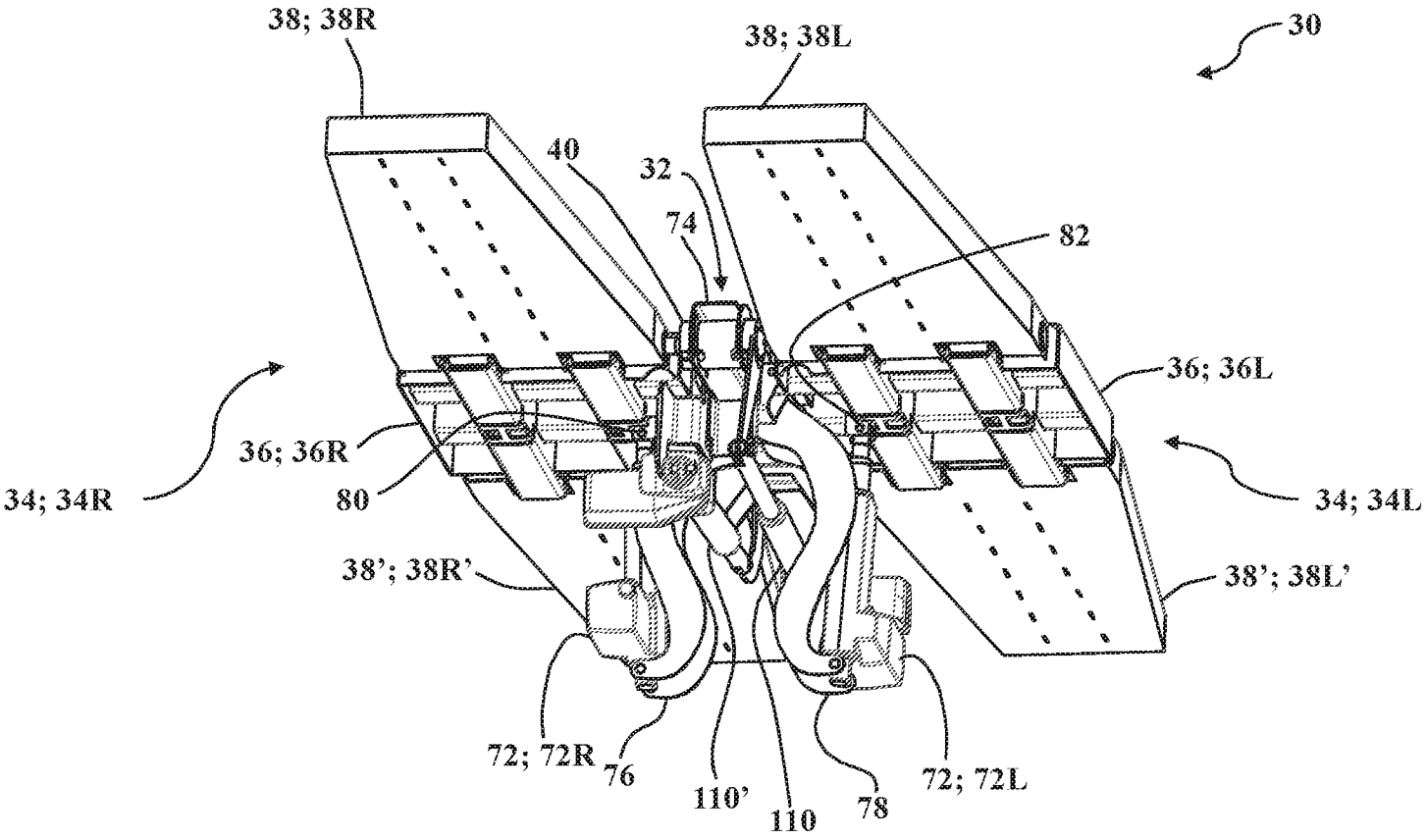
FIG. 3 is a bottom-side perspective view of the support frame and support decks of the patient support apparatus of FIG. 2 showing a pair of deck actuators and a joint assembly interposed between the support frame and the support decks.
Figure 13A:
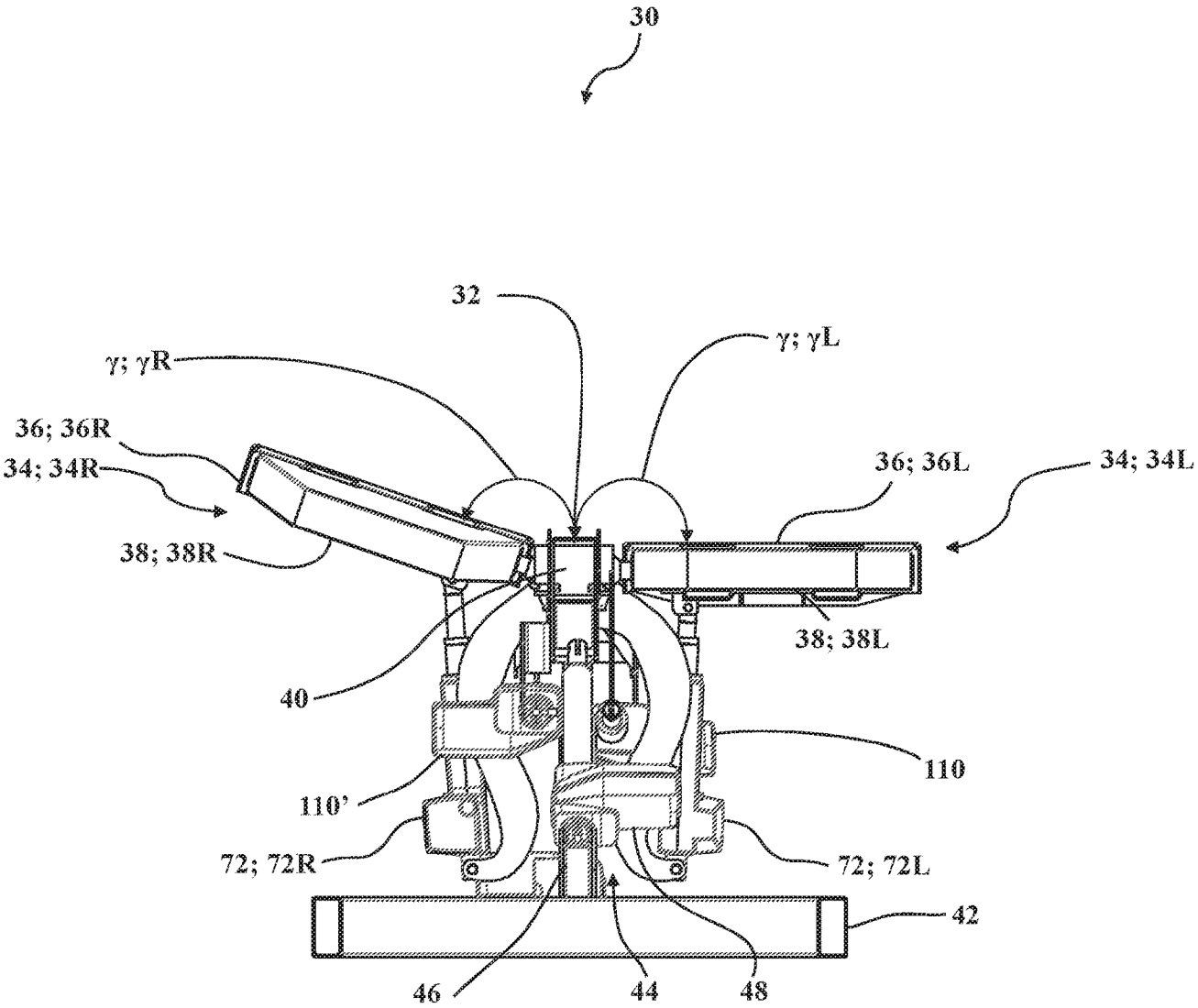
FIG. 13A is a front-side view of the patient support apparatus of FIG. 1 shown in a first longitudinal support configuration.
Figure 13B:
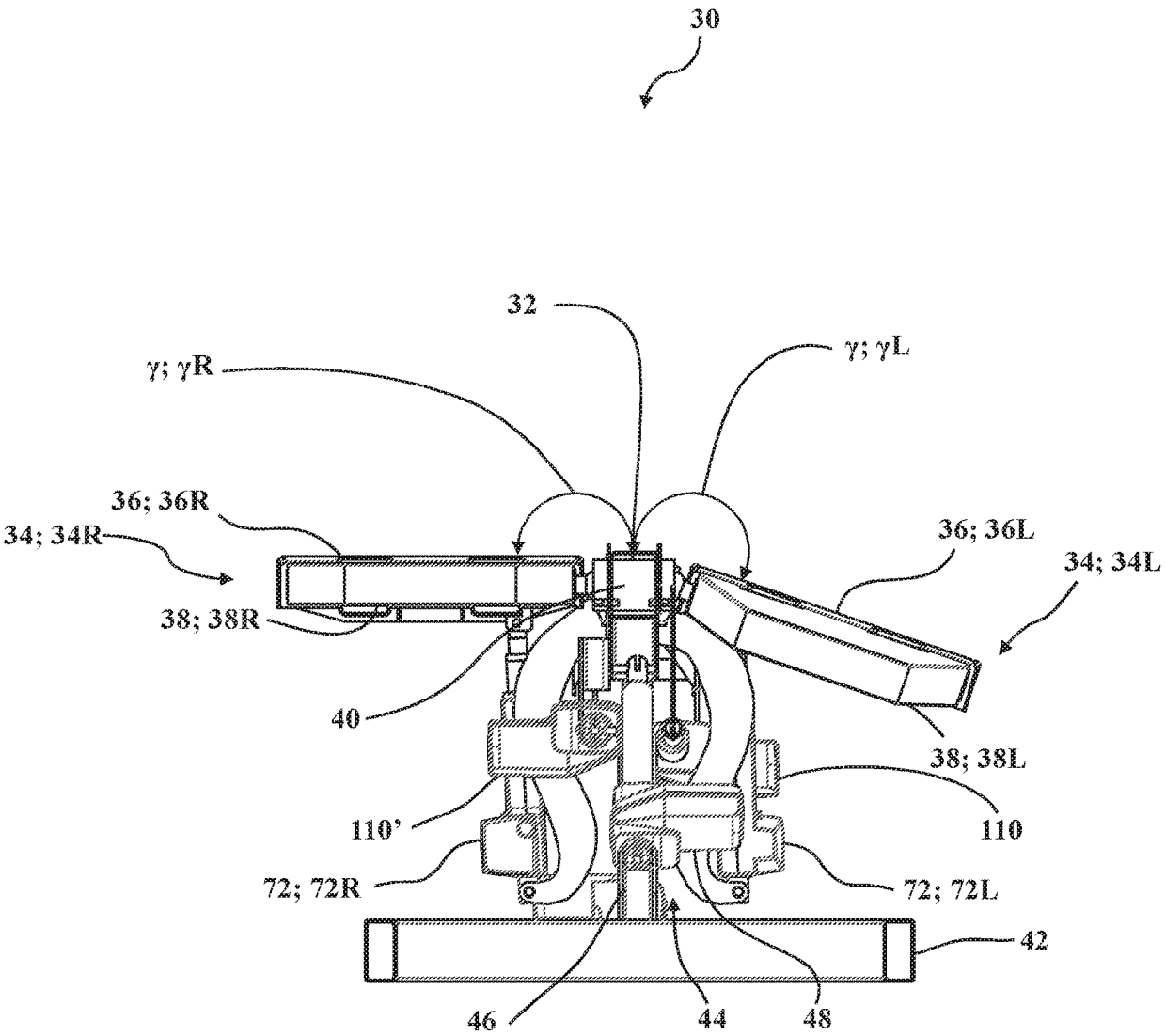
FIG. 13B is a front-side view of the patient support apparatus of FIG. 1 shown in a second longitudinal support configuration.
Figure 13C:
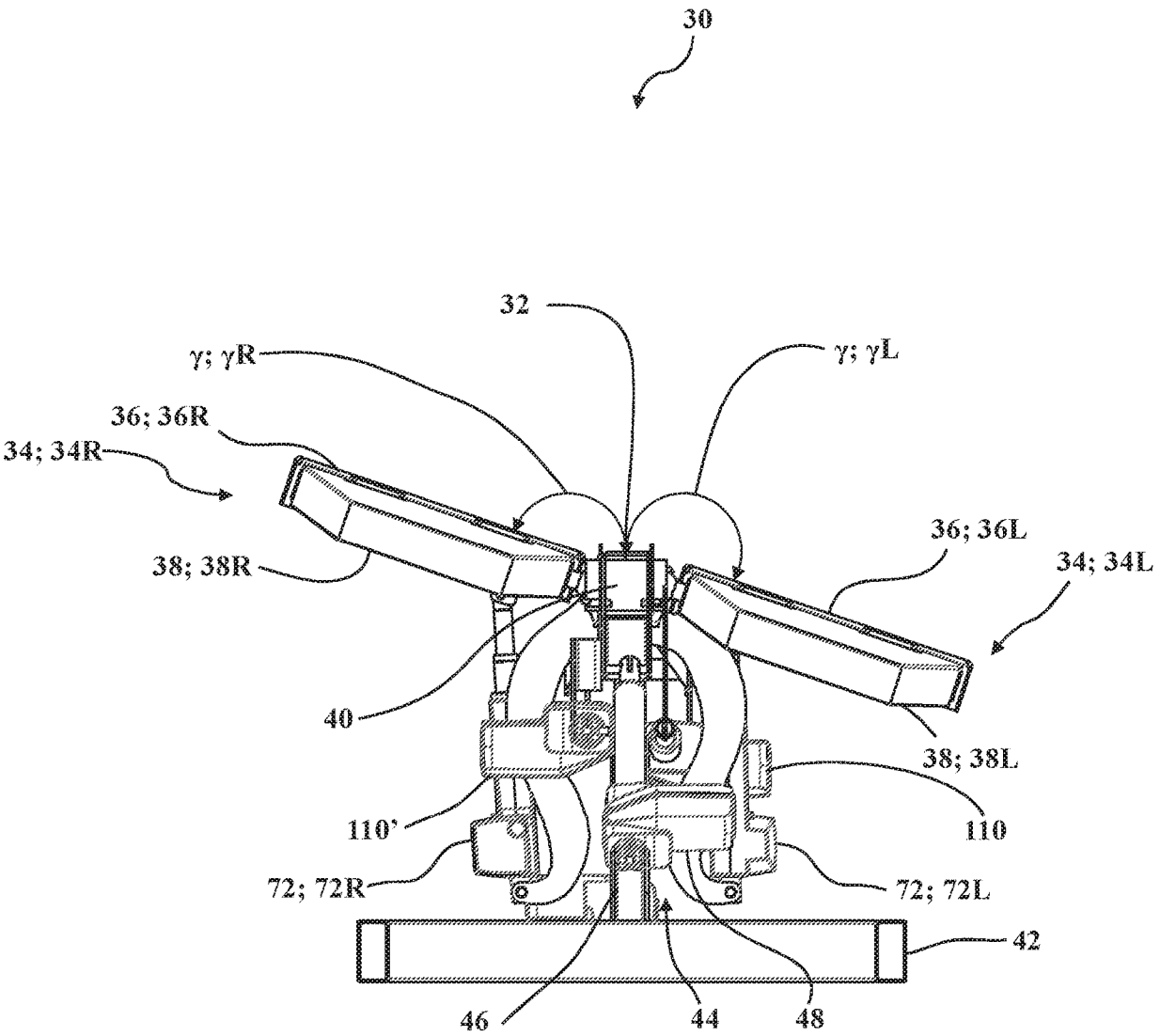
FIG. 13C is a front-side view of the patient support apparatus of FIG. 1 shown in a third longitudinal support configuration.

As is best shown in FIGS. 13A-13C, a tilt angle $\gamma$ is defined between each of the seat sections 36 and the support frame 32. More specifically, the left seat section 36L forms a left tilt angle $\gamma L$ with the support frame 32, and the right seat section 36R forms a right tilt angle $\gamma R$ with the support frame 32. The tilt angles $\gamma L$, $\gamma R$ represent angular positions of the respective seat sections 36L, 36R relative to the support frame 32. As is described in greater detail below, each longitudinal support configuration may be defined by a certain predetermined left tilt angle $\gamma L$ and/or right tilt angle $\gamma R$. To this end, and as is best shown in FIGS. 3 and 4, in one embodiment the patient support apparatus 30 further comprises a pair of deck actuators 72 each interposed in force-translating relationship between the support frame 32 and one of the support decks 34. More specifically, and according to one embodiment, the pair of deck actuators 72 are further defined as a left deck actuator 72L and a right deck actuator 72R.

Figure 12A:
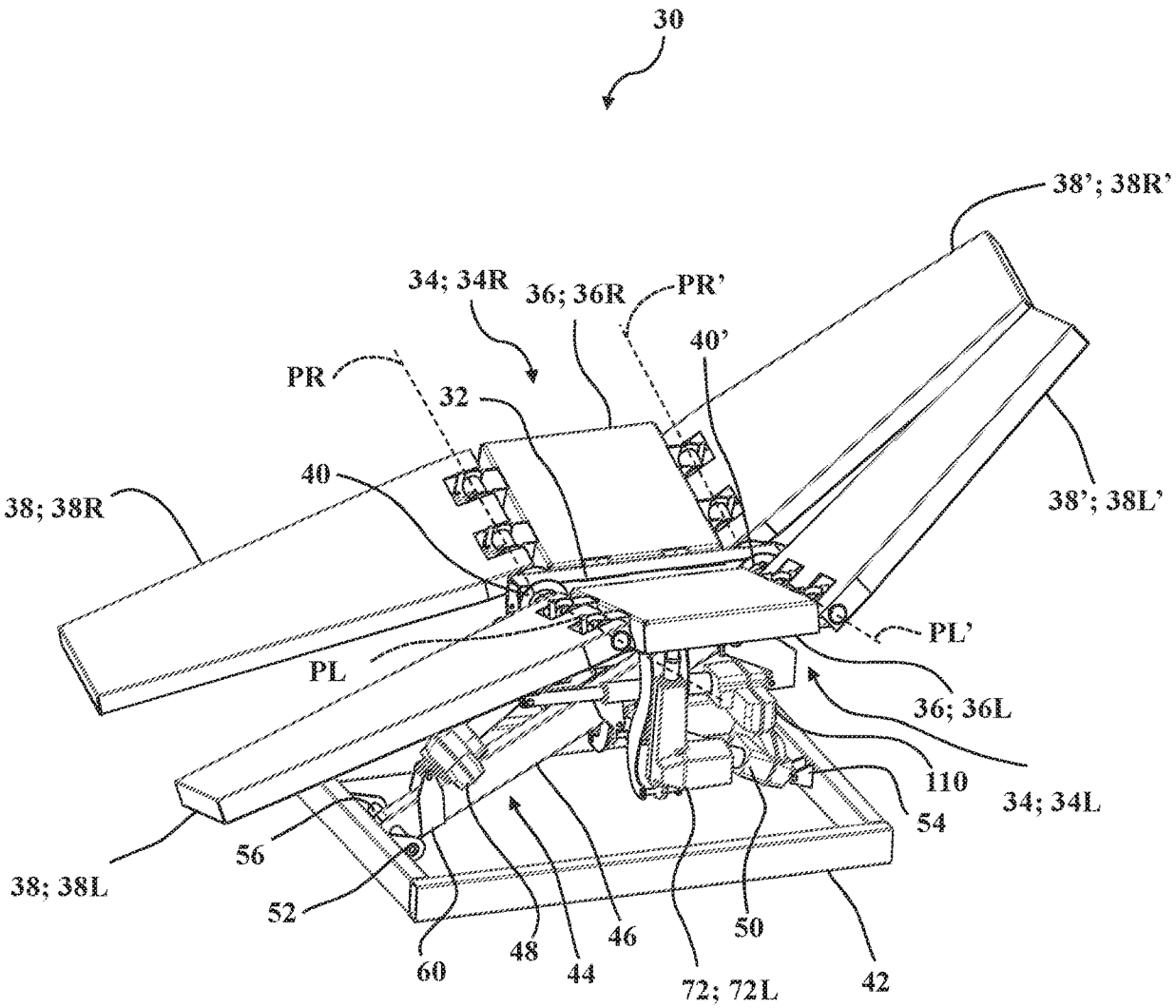
FIG. 12A is a perspective view of the patient support apparatus of FIG. 1 shown in a cradle position.
Figure 12B:
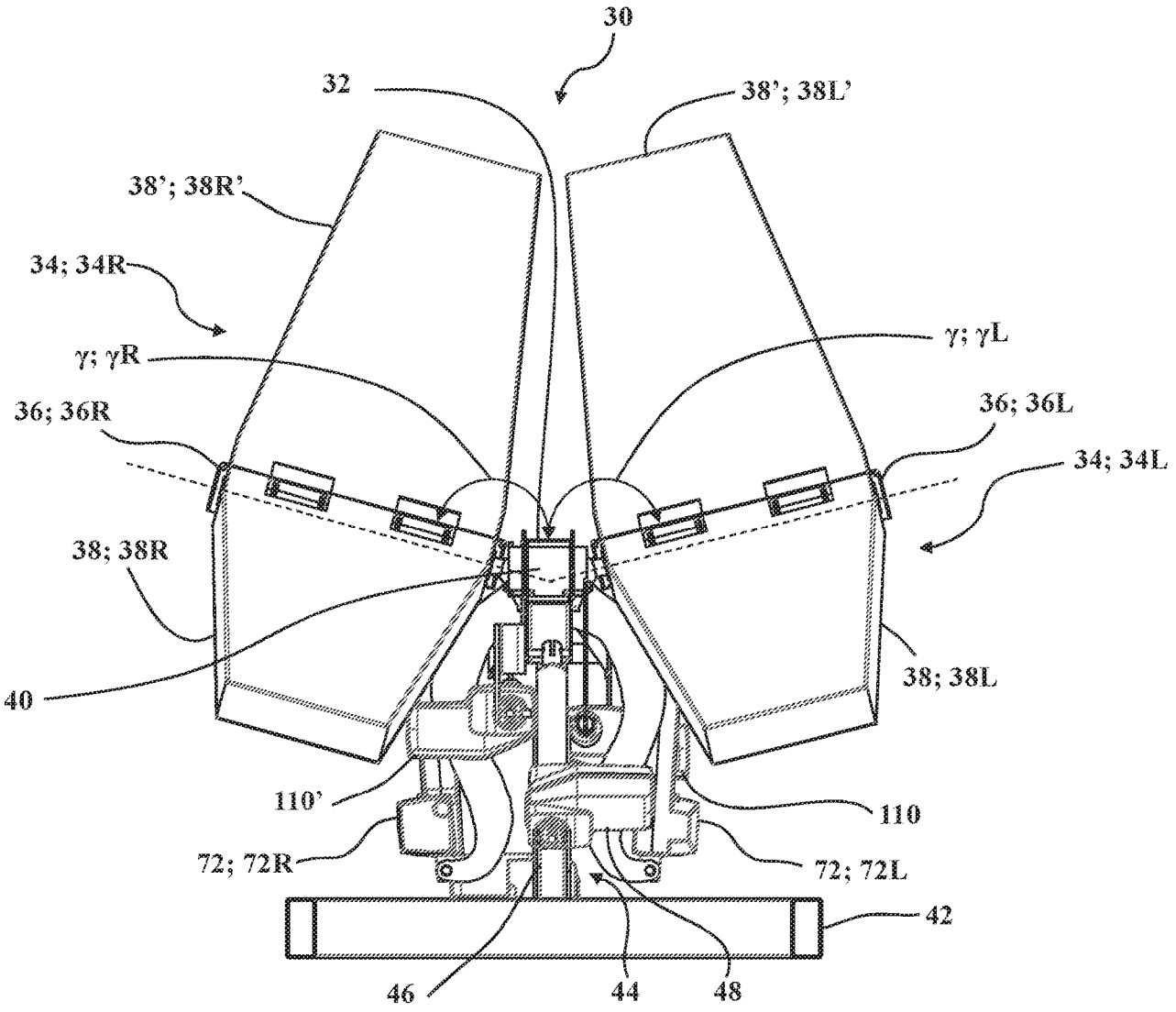
FIG. 12B is a front-side view of the patient support apparatus in the cradle position as depicted in FIG. 12A.

As is shown best in FIGS. 3 and 4, the left deck actuator 72L is arranged between the support frame 32 and the left support deck 34L, and the right deck actuator 72R is arranged between the support frame 32 and the right support deck 34R. To this end, the support frame 32 is comprised of a longitudinal member 74 to which a left tilt mount 76 and a right tilt mount 78 are operatively attached (see also FIG. 5), the left support deck 34L has a left deck mount 80, and the right support deck 34R has a right deck mount 82. The left deck actuator 72L is pivotally attached to both the left tilt mount 76 of the support frame 32 and to the left deck mount 80 of the left support deck 34L, and the right deck actuator 72R is pivotally attached to both the right tilt mount 78 of the support frame 32 and to the right deck mount 82 of the right support deck 34R. Here, the deck actuators 72L, 72R are employed to facilitate independent and selective adjustment of the tilt angles γL, γR between the support frame 32 and the respective seat sections 36L, 36R. As is described in greater detail below in connection with the joint assembly 40, selective and independent adjustment of the tilt angles γL, γR may be effected while ensuring that the common angle β is maintained between the left seat section 36L and the left auxiliary section 38L, as well as between the right seat section 36R and the right auxiliary section 38R. In other words, the left and right auxiliary sections 38L, 38R will be at the same angle relative to the respective left and right seat sections 36L, 36R. An example of this is illustrated in FIGS. 12A and 12B.

Referring now to FIGS. 4-7, as noted above, the joint assembly 40 is coupled to the support frame 32 and to the support decks 34L, 34R and is arranged to concurrently position both of the auxiliary sections 38L, 38R at the common angle β defined with respect to the corresponding seat sections 36L, 36R. More specifically, the joint assembly 40 is arranged to position the left auxiliary section 38L at the common angle β with respect to the left seat section 36L and, at the same time, is arranged to position the right auxiliary section 38R at the common angle β with respect to the right seat section 36R. Moreover, the joint assembly 40 maintains the common angle β of both the left auxiliary section 38L and the right auxiliary section 38R, irrespective of the tilt angles γL, γR of the respective seat sections 36L, 36R relative to the support frame 32. As will be appreciated, the joint assembly 40 permits both the tilt angles γL, γR as well as the common angle β to be adjusted independently of the other. For example, either of the seat sections 36L, 36R may be tilted up or down while the auxiliary sections 38L, 38R are positioned up or down (compare FIGS. 11A and 12A).

In one embodiment, the joint assembly 40 comprises a hub, generally indicated at 84, and a pair of links, generally indicated at 86. The hub 84 is rotatably supported within a hub bore 88 (see FIG. 5) formed in the longitudinal member 74 of the support frame 32. The links 86 are operatively attached to the hub 84 and are configured for concurrent rotation with the hub 84 such that rotation of the hub 84 also rotates the links 86 to move the auxiliary sections 38 at the common angle β irrespective of the tilt angles γL, γR of the respective seat sections 36L, 36R relative to the support frame 32, as noted above.

Figure 6:
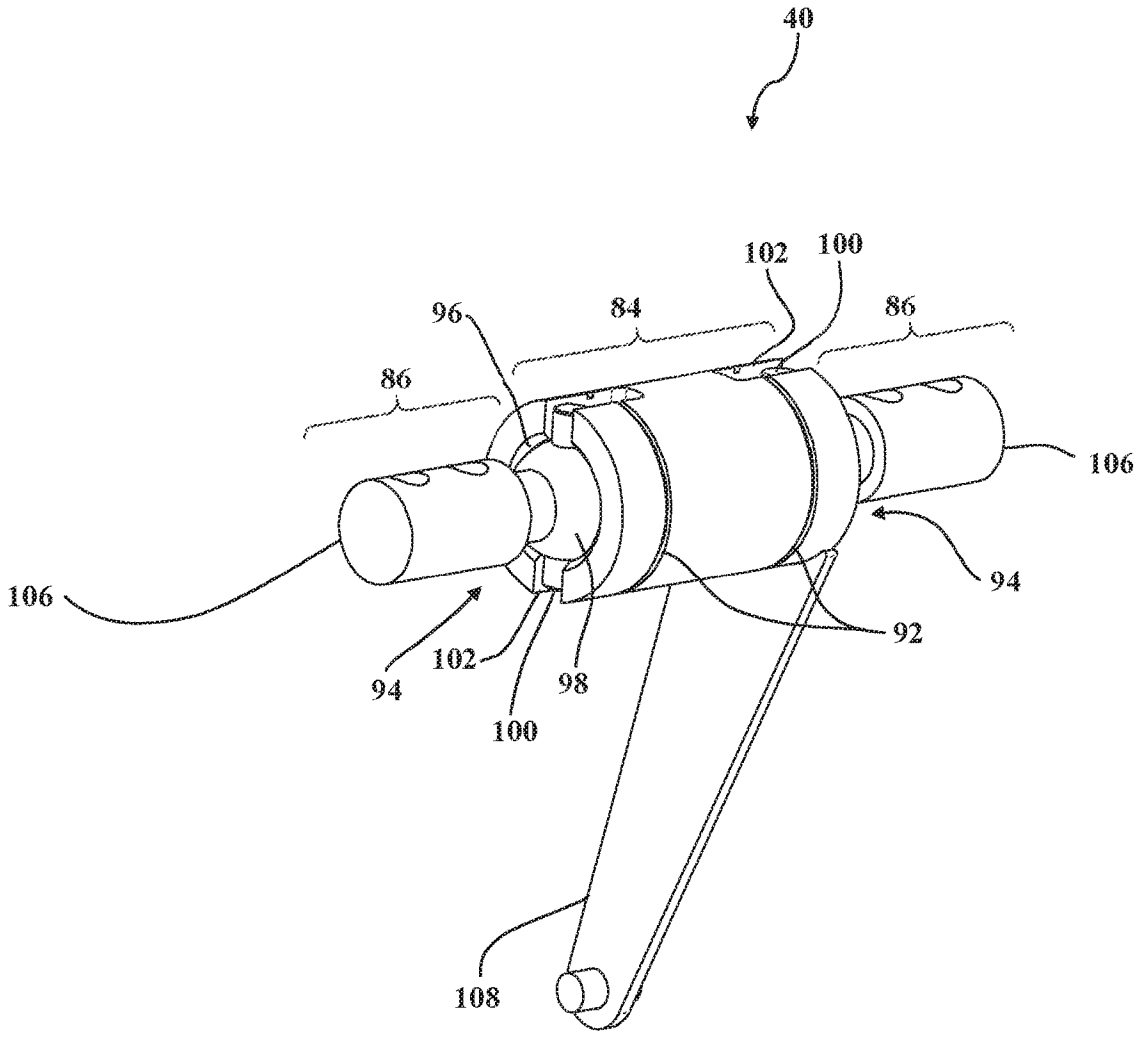
FIG. 6 is a perspective view of one of the joint assemblies of FIG. 5 shown having a hub, a pair of links, and a crank arm.
Figure 7:
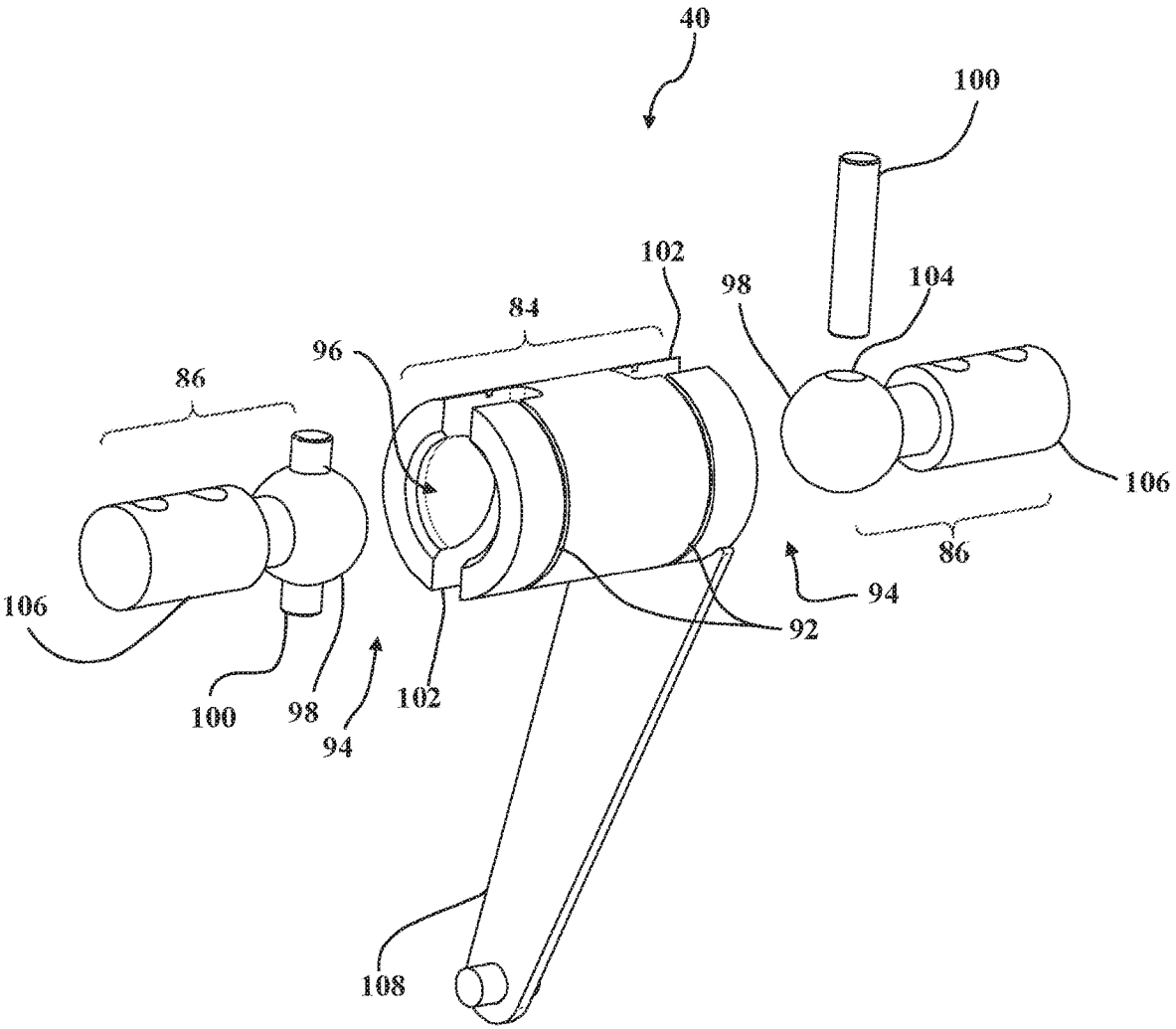
FIG. 7 is an exploded perspective view of the joint assembly shown in FIG. 6 shown with the links spaced from the hub.

As is best shown in FIG. 5, the hub 84 of the joint assembly 40 is axially constrained within the hub bore 88 formed in the longitudinal member 74 of the support frame 32 via circlip fasteners 90 seated in corresponding grooves 92 formed in the hub 84 adjacent each of the respective links 86 (see also FIGS. 6 and 7). Here, the circlip fasteners 90 cooperate to limit axial movement of the hub 84 of the joint assembly 40 with respect to the longitudinal member 74 of the support frame 32. As will be appreciated from the subsequent description below, the joint assembly 40 can be configured in any suitable way sufficient to facilitate concurrent movement of the auxiliary sections 38. By way of non-limiting example, the joint assembly 40 could be axially constrained to or rotatably supported by any suitable portion of the support frame 32, with or without the use of circlip fasteners 90.

With continued reference to FIGS. 5-7, in the representative embodiment of the joint assembly 40 illustrated herein, the hub 84 and the links 86 cooperate to define a pair of swivel joints, generally indicated at 94, which effect concurrent rotation of the links 86 with the hub 84. Here, each link 86 defines a respective swivel joint 94 with the hub 84 (see FIG. 6). The swivel joints 94 each comprise a socket 96 and a ball 98 supported in the socket 96. Each of the swivel joints 94 is further provided with a trunnion 100 and a slot 102. Here, each of the links 86 is provided with a respective trunnion 100 formed at the ball 98, and the hub 84 is provided with a corresponding slot 102 formed at the respective sockets 96. Here, the slots 102 of the hub 84 are arranged to accommodate and receive the respective trunnions 100 of the links 86 so as to limit rotation of the links 86 with respect to the hub 84 while, at the same time, allowing the links 86 to move relative to the hub 84 via engagement of the balls 98 in the sockets 96. This arrangement allows the tilt angles γL, γR of the respective seat sections 36L, 36R relative to the support frame 32 to be adjusted while ensuring concurrent rotation of the hub 84 and links 86, which ensures that the auxiliary sections 38L, 38R are both maintained at the common angle β with respect to their corresponding seat sections 36L, 36R. In other words, the trunnions 100 and the slots 102 cooperate to constrain one degree of freedom in addition to two degrees of freedom constrained by the engagement of the sockets 96 and the balls 98. More specifically, the trunnions 100 constrain rotation of the links 86 to rotate at the same rate as the hub 84 while the sockets 96 and balls 98 constrain lateral translation.

In the representative embodiment illustrated herein, the balls 98 of the links 86 each define an aperture 104 arranged perpendicular to rotation of the respective link 86. The apertures 104 are generally cylindrical and are formed extending through the balls 98 so as to receive the correspondingly shaped cylindrical trunnions 100. In one embodiment, the trunnions 100 are disposed in the respective apertures 104 and protrude from antipodal points of the balls 98. Each link 86 further comprises an engagement portion 106 extending from the ball 98 transverse to the aperture 104 and trunnion 100. The engagement portions 106 are configured to engage with the respective auxiliary sections 38L, 38R for concurrent rotation therewith, such as via fasteners, welding, and the like (not shown). However, it will be appreciated that the engagement portions 106 could be coupled to the auxiliary sections 38L, 38R with other suitable methods known in the art, such as via splines, threads, and the like.

Those having ordinary skill in the art will appreciate that the links 86 could each be formed as a unitary, one-piece component with integral trunnions 100 and engagement portions 106. Moreover, while a pair of sockets 96 are formed in the hub 84 and each of the links 86 is provided with a ball 98 in the representative embodiment illustrated herein, it will be appreciated that other arrangements are conceivable, such as with a hub 84 provided with a pair of balls and each link 86 provided with a corresponding socket, or with a hub 84 provided with one ball and one socket. Similarly, it will be appreciated that the arrangement of the trunnions 100 and/or the slots 102 could be interchanged.

As noted above, rotation of the hub 84 of the joint assembly 40 causes simultaneous articulation of the auxiliary sections 38 via the links 86. To this end, in one embodiment, the joint assembly 40 is further provided with a crank arm 108 coupled to the hub 84 for concurrent rotation with the hub 84. Here, the patient support apparatus 30 also includes an auxiliary actuator 110 interposed in force-translating relationship between the support frame 32 and the hub 84. More specifically, the auxiliary actuator 110 is interposed in force-translating relationship between the support frame 32 and the crank arm 108 (see FIG. 5). The crank arm 108 is shaped to provide mechanical advantage in rotating the hub 84, and may be of any suitable shape or configuration. The auxiliary actuator 110 is configured to rotate the hub 84 so as to adjust the first common angle of each of the auxiliary section 38 relative to the respective seat section 36, as noted above. To this end, an auxiliary mount 112 operatively attached to the support frame 32 pivotally supports the auxiliary actuator 110 between the support frame 32 and the crank arm 108 of the joint assembly 40.

As noted above, the support frame 32 is provided with the longitudinal member 74. Here, the longitudinal member 74 has an elongated and generally rectangular profile and serves to support the joint assemblies 40, the first frame mount 64, the second frame mount 66, the frame hinge mounts 68L, 68R, the left tilt mount 76, and the right tilt mount 78. The first frame mount 64, the second frame mount 66, and the frame hinge mounts 68L, 68R each have a generally u-shaped profile and are operatively attached to the longitudinal member 74, such as via welding. Similarly, the left tilt mount 76 and the right tilt mount 78 are operatively attached to the longitudinal member 74, such as via welding. Here, however, the left tilt mount 76 and the right tilt mount 78 have a generally s-shaped curved profile shaped and are arranged to accommodate the auxiliary actuator 110, which promotes efficient packaging of the various components of the patient support apparatus 30 and contributes to a reduced overall packaging size.

As noted above, the patient support apparatus 30 employs one of the joint assemblies 40 coupled to the support frame 32 and to the support decks 34 to concurrently position both of the auxiliary sections 38 at the common angle β defined with respect to the corresponding seat sections 36. In the representative embodiment illustrated in FIGS. 1-13C, the patient support apparatus 30 is provided with first and second joint assemblies 40, 40' and the support decks 34 are each provided with first and second auxiliary sections 38, 38' movable to corresponding first and second common angles β, β'. More specifically, the left support deck 34L has a left seat section 36L to which a first left auxiliary section 38L and second left auxiliary section 38L' are operatively attached, and the right support deck 34R has a right seat section 36R to which a first right auxiliary section 38R and a second right auxiliary section 38R' are operatively attached. Here, both the first joint assembly 40 and the second joint assembly 40' are coupled to the support frame 32 and to the support decks 34L, 34R. The first joint assembly 40 is arranged to concurrently position the first auxiliary sections 38L, 38R at the first common angle β relative to the seat sections 36L, 36R. Similarly, the second joint assembly 40' is arranged to concurrently position the second auxiliary sections 38L', 38R' at the second common angle β' relative to the seat sections 36L, 36R.

It will be appreciated that the implementation of the support decks 34 with first and second auxiliary sections 38, 38' which are independently articulable relative to the seat sections 36 between the first and second common angle β, β' affords significant opportunities for positioning or otherwise supporting patients in a number of different configurations, orientations, and the like, as is described in greater detail below. Here, the first auxiliary sections 38L, 38R may be arranged to provide support to the legs, calves, ankles, and/or feet of the patient's body, and the second auxiliary sections 38L', 38R' may be arranged to provide support to the torso, chest, arms, shoulders, and/or head of the patient's body. Moreover, as noted above in connection with the description of the left and right designations associated with the support decks 34, it will be appreciated that the first and second auxiliary sections 38, 38' could be configured to provide support to any suitable part of the patient's body. Thus, like the designations of "left" and "right" noted above, the designations of "first" and "second" are intended to be exemplary, non-limiting, and interchangeable.

As is best shown in FIG. 5, the first and second joint assemblies 40, 40' are spaced from each other along the longitudinal member 74 of the support frame 32, and each is actuated using a respective first and second auxiliary actuator 110, 110' arranged in force-translating relationship between a respective crank arm 108, 108' and auxiliary mount 112, 112'. Advantageously, the first and second joint assemblies 40, 40' are spaced with respect to the first frame mount 64, the second frame mount 66, the frame hinge mounts 68L, 68R, the left tilt mount 76, and the right tilt mount 78 so as to facilitate a broad range of movement and positioning of the seat sections 36 and the first and second auxiliary sections 38, 38' of each of the support decks 34, as is described in greater detail below.

The seat sections 36 and the first and second auxiliary sections 38, 38' of the support decks 34 are advantageously sized, shaped, and arranged so as to promote a broad range of movement. To this end, as is depicted in the representative embodiment illustrated in FIGS. 1-13C, the seat sections 36 have a generally rectangular profile, and the first and second auxiliary sections 38, 38' have a proximal end 114 and a distal end 116 with a generally trapezoidal profile extending from the proximal end 114 to the distal end 116. As is described in greater detail below, the tapered profile of the auxiliary sections 38 further promotes broad articulation between longitudinal support configurations. In one embodiment, and as best shown in FIG. 9, the auxiliary sections 38 each define a first width 118 adjacent to the proximal end 114 and a second width 120 adjacent to the distal end 116, and a ratio defined between the first width and the second width is at least 1.5:1. However, those having ordinary skill in the art will appreciate that the ratio may be other than 1.5 so as to avoid interference between the left auxiliary sections 38L and the right auxiliary sections 38R. By way of non-limiting example, the ratio may be 2.0:1, 2.5:1, 3.5:1, and the like. In addition, it is conceivable that the auxiliary sections 38 could employ a distal end 116 without a significant second width 120, such as where the auxiliary section 38 is shaped with a substantially triangular profile.

As noted above, each of the first and second auxiliary sections 38, 38' are pivotally attached to one of the seat sections 36 adjacent to their respective proximal end 114, such as by a hinge/pin mount (not shown in detail). Here, the left seat section 36L pivots with respect to the support frame 32 about the left longitudinal axis AL, the first left auxiliary section 38L articulates about a first left pivot axis PL arranged transverse to the left longitudinal axis AL, and the second left auxiliary section 38L' articulates about a second left pivot axis PL' also arranged transverse to the left longitudinal axis AL. Similarly, the right seat section 36R pivots with respect to the support frame 32 about the right longitudinal axis AR, the first right auxiliary section 38R articulates about a first right pivot axis PR arranged transverse to the right longitudinal axis AR, and the second right auxiliary section 38R' articulates about a second right pivot axis PR' also arranged transverse to the right longitudinal axis AR. It is to be appreciated that when the left longitudinal axis AL is spaced from the right longitudinal axis AR air may be forced, or flow naturally between the seat sections 36L, 36R to increase patient comfort.

As noted above, the patient support apparatus 30 employs the first lift actuator 48 and the second lift actuator 50 to adjust the height and/or angle of the support frame 32 and support decks 34 relative to the base 42, employs the deck actuators 72L, 72R to adjust the tilt angles γL, γR of the seat sections 36L, 36R of the support decks 34L, 34R relative to the support frame 32, and employs the auxiliary actuators 110, 110' to adjust the common angles β, β' of the auxiliary sections 38, 38' relative to the seat sections 36. In the representative embodiment illustrated herein, and as is depicted schematically in FIG. 14, each of the actuators 48, 50, 72L, 72R, 110, 110' are selectively and independently drivable via a controller, generally indicated at 122. While the actuators 48, 50, 72L, 72R, 110, 110' are realized as linear actuators, those having ordinary skill in the art will appreciate that the actuators could be of any suitable size, type, or configuration and could be driven, actuated, or otherwise controlled in any suitable way. By way of non-limiting example, the auxiliary actuators may be realized with a ring gear (not shown) operably coupled to the hub drivable with a pinion gear (not shown) coupled to an electric motor (not shown). Moreover, it will be appreciated that one or more actuators could be omitted for certain applications, such as with a single lift actuator arranged to move the support frame 32 relative to the base 42. Similarly, a single actuator could be used in connection with a linkage, geartrain, and the like to concurrently move certain portions of the patient support apparatus 30 where application requirements do not necessitate broad independent and selective movement of those portions. Moreover, it will be appreciated that manually-actuated linkages, geartrains, and the like could be used in place of certain actuators where application requirements do not necessitate powered articulation and/or movement.

Figure 14:
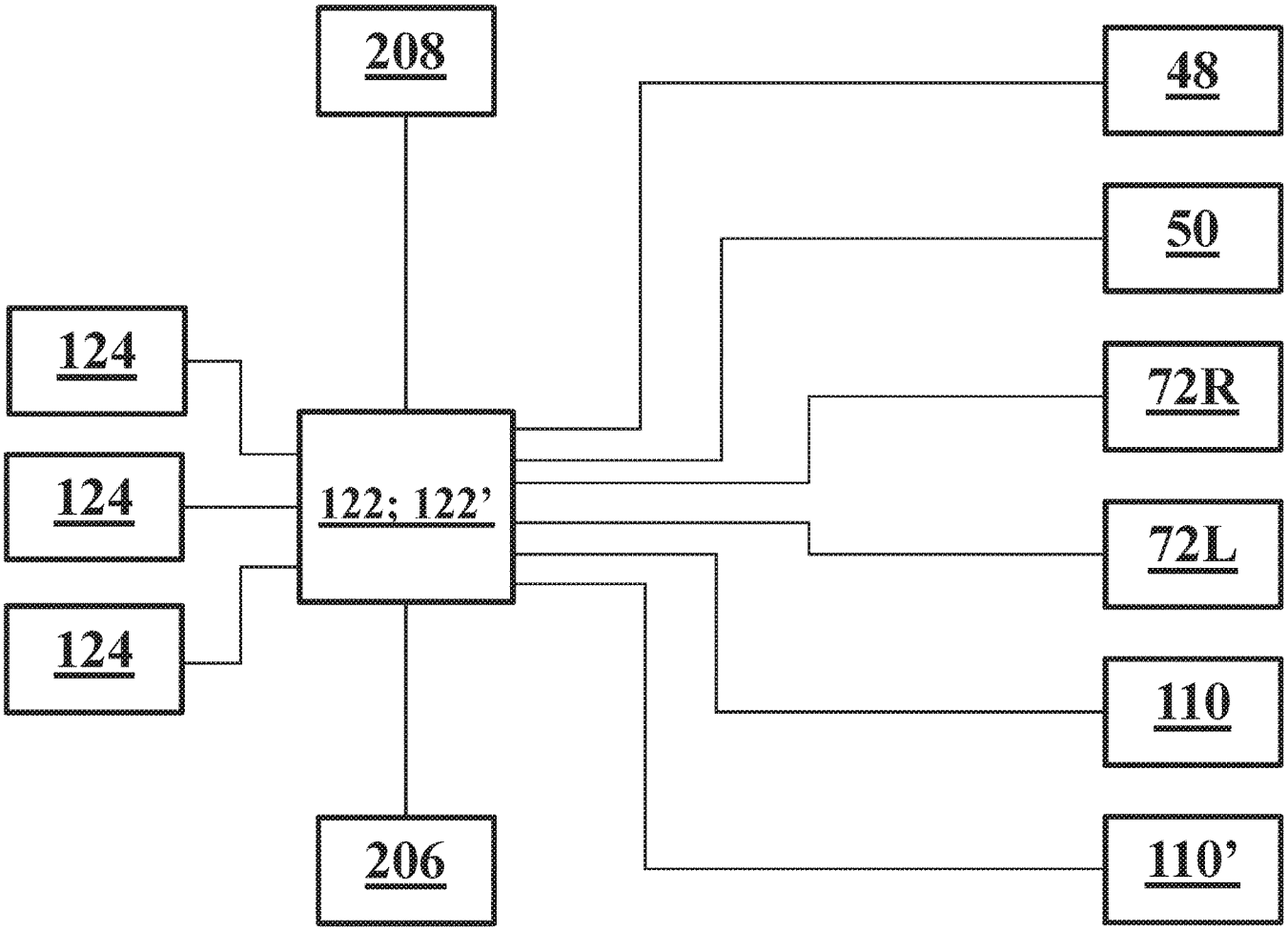
FIG. 14 is a schematic view of a controller and actuators for the patient support apparatus.

With continued reference to FIG. 14, the controller 122 is schematically depicted in communication with the actuators 48, 50, 72L, 72R, 110, 110'. Those having ordinary skill in the art will appreciate that the actuators 48, 50, 72L, 72R, 110, 110' could be powered, driven, or otherwise disposed in communication with the controller 122 electrically, pneumatically, hydraulically, or in any other suitable way. Additionally the controller 122 may be configured to independently operate any of the actuators 48, 50, 72L, 72R, 110, 110' or may be configured to cooperatively operate two or more of the actuators 48, 50, 72L, 72R, 110, 110' simultaneously, such as when moving from different configurations of the patient support apparatus 30.

In one embodiment, the controller 122 is configured to selectively and independently drive the first lift actuator 48 and the second lift actuator 50 to effect articulated movement of the support frame 32 relative to the base 42. By driving the first and second lift actuators 48, 50, the controller 122 can effect broad vertical and/or pivoting movement of the support frame 32 and the support decks 34 relative to the base 42.

In one embodiment, the controller 122 is configured to selectively and independently drive the first and second auxiliary actuators 110, 110' to effect independent movement of said first and second auxiliary sections 38, 38'. By driving the first and second auxiliary actuators 110, 110', the controller 122 can adjust the respective common angles β, β' of the auxiliary sections 38, 38' relative to the seat sections 36 both independently and selectively.

In one embodiment, the controller 122 is configured to selectively and independently drive the left deck actuator 72L and the right deck actuator 72R so as to effect coordinated movement of the left support deck 34L and the right support deck 34R relative to each other and to the support frame 32. By driving the left deck actuator 72L and the right deck actuator 72R, the controller 122 can adjust the tilt angles γL, γR of the seat sections 36L, 36R of the support decks 34L, 34R relative to the support frame 32 both independently and selectively.

In one embodiment, the controller 122 is configured to selectively and independently drive the first auxiliary actuator 110 to effect simultaneous movement of first left auxiliary section 38L and the first right auxiliary section 38R at the first common angle β relative to the respective left seat section 36L and right seat section 36R. Similarly, in one embodiment, the controller 122 is configured to selectively and independently drive the second auxiliary actuator 110' to effect simultaneous movement of second left auxiliary section 38L' and the second right auxiliary section 38R' at the second common angle β' relative to the respective left seat section 36L and right seat section 36R. By driving the first and second auxiliary actuators 110, 110', the controller can independently and selectively adjust the first and second common angles β, β' of the respective auxiliary sections 38, 38' relative to the corresponding seat sections 36.

The patient support apparatus 30 may further be provided with one or more user input devices 124 in communication with the controller 122. The caregiver, or other user, may actuate one of the user input devices 124, which transmits a corresponding input signal to the controller 122, and the controller 122 controls operation of the corresponding actuator based on the input signal. Operation of the corresponding actuator may continue until the caregiver discontinues actuation of the user input device 124, e.g., until the input signal is terminated. In other words, depending on which user input device 124 is engaged, i.e., what input signal is received by the controller 122, the controller 122 controls operation of one of the actuators 48, 50, 72L, 72R, 110, 110'. In certain embodiments, the controller 122 selects or initiates operation of one or more of the actuators 48, 50, 72L, 72R, 110, 110' based on the input signals received by the controller 122.

The user input devices 124 may comprise devices capable of being actuated by a user, such as the caregiver or the patient. The user input devices 124 may be configured to be actuated in a variety of different ways, including but not limited to, mechanical actuation (hand, foot, finger, etc.), hands-free actuation (voice, foot, etc.), and the like. Each user input device 124 may comprise a button, a gesture sensing device for monitoring motion of hands, feet, or other body parts of the caregiver (such as through a camera), a microphone for receiving voice activation commands, a foot pedal, and a sensor (e.g., infrared sensor such as a light bar or light beam to sense a user's body part, ultrasonic sensor, etc.). Additionally, the buttons/pedals can be physical buttons/pedals or virtually implemented buttons/pedals such as through optical projection or on a touchscreen. It should be appreciated that any combination of user input devices 124 may also be utilized for any of the actuators. The user input devices 124 may be located on the patient support apparatus 30, or other suitable locations. The user input devices 124 may also be located on a portable electronic device (e.g., Apple Watch®, iPhone®, iPad®, or similar electronic devices).

In one embodiment, the patient support apparatus 30 comprises a user control panel (not shown) that comprises numerous user input devices 124 in the form of buttons. The buttons may be mechanical press buttons, virtual buttons on a touch screen, and the like. Furthermore, as should be appreciated, the patient support apparatus may comprise any number of actuators and the corresponding user input devices 124. Each of the buttons control different predetermined functions of one or more of the actuators.

As noted above, the patient support apparatus 30 is configured to effect broad, selective movement of the support decks 34 between various longitudinal support configurations so as to provide correspondingly broad support to the patient's body in different orientations. Referring now to FIGS. 1 and 8-13C, various positions of the patient support apparatus 30 and various longitudinal support configurations of the support decks 34 are shown.

Figure 8:
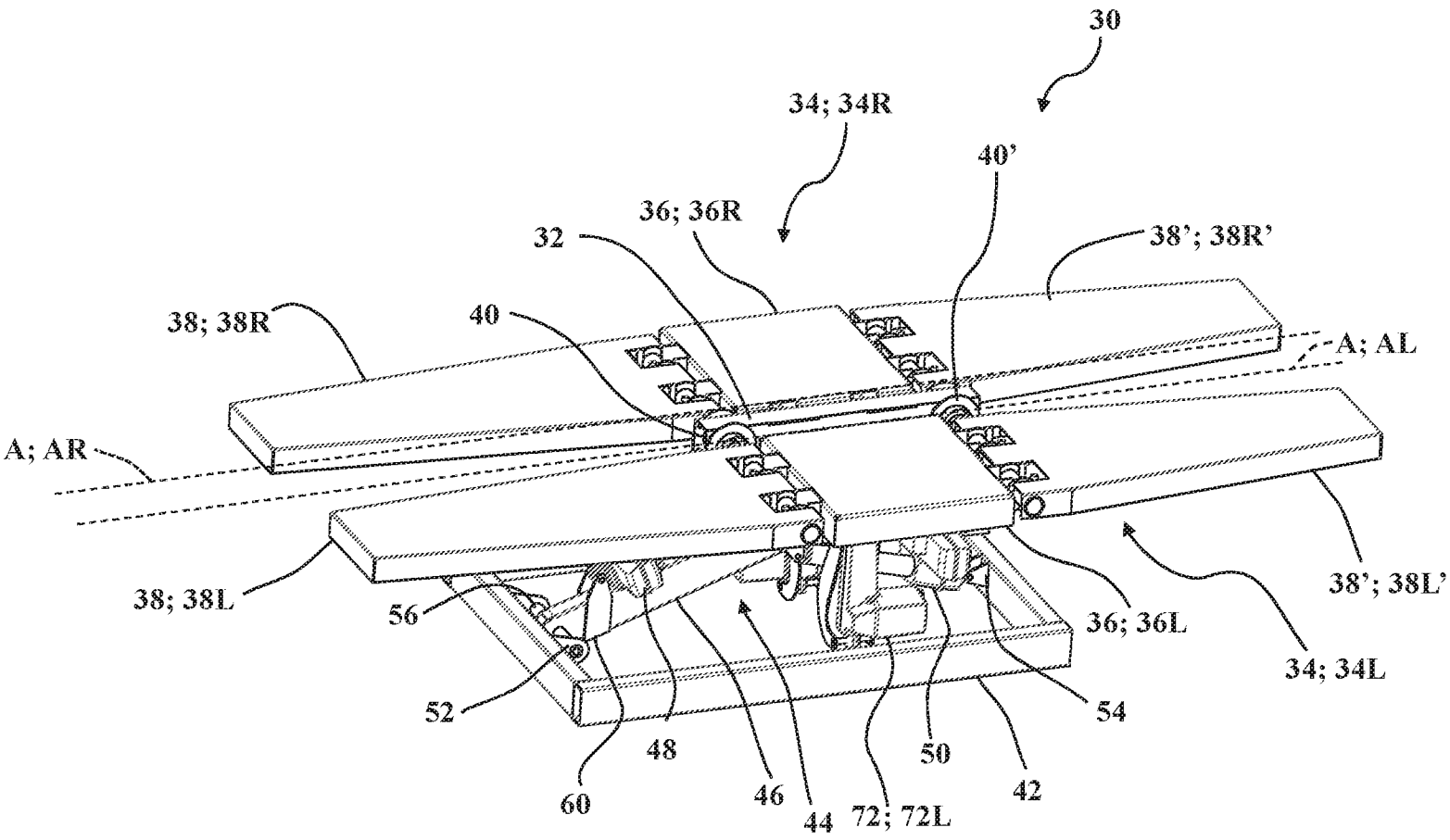
FIG. 8 is a perspective view of the patient support apparatus of FIG. 1 shown in a lowered position.
Figure 9:
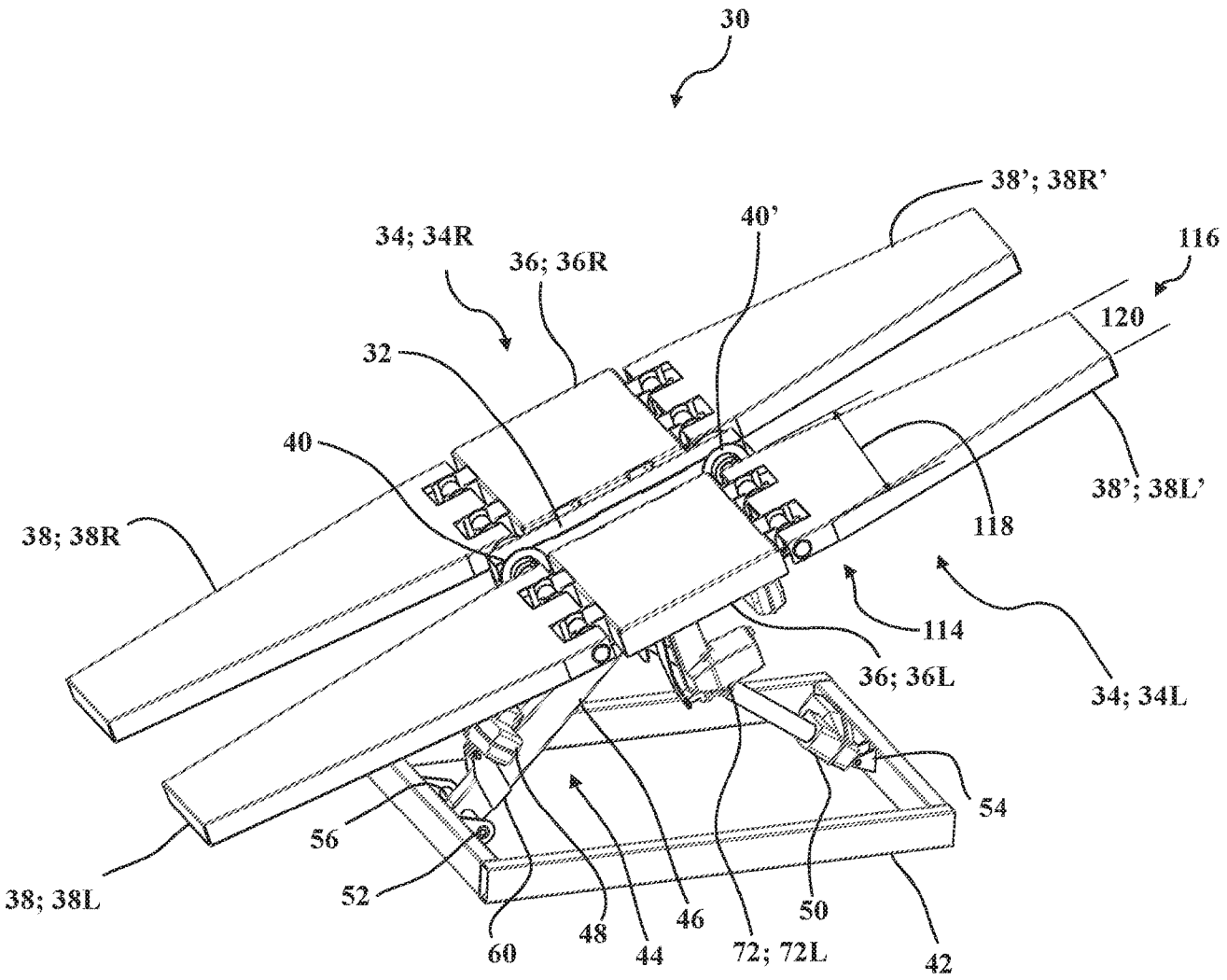
FIG. 9 is a perspective view of the patient support apparatus of FIG. 1 shown in a reverse Trendelenburg position.

In FIG. 8, the support frame 32 and support decks 34 are arranged nearer to the base 42 in a lowered position which may advantageously promote patient ingress or egress. It will be appreciated that the patient support apparatus 30 may also be movable into a further raised position in which the patient is more accessible to a caregiver. In order to effect vertical movement of the support frame 32 relative to the base 42, the first lift actuator 48 and the second lift actuator 50 may operate simultaneously. Here, the first lift actuator 48 pivots the support frame 32 relative to the intermediate brace 46 and the second lift actuator 50 pivots the intermediate brace 46 relative the base 42.

Figure 10:
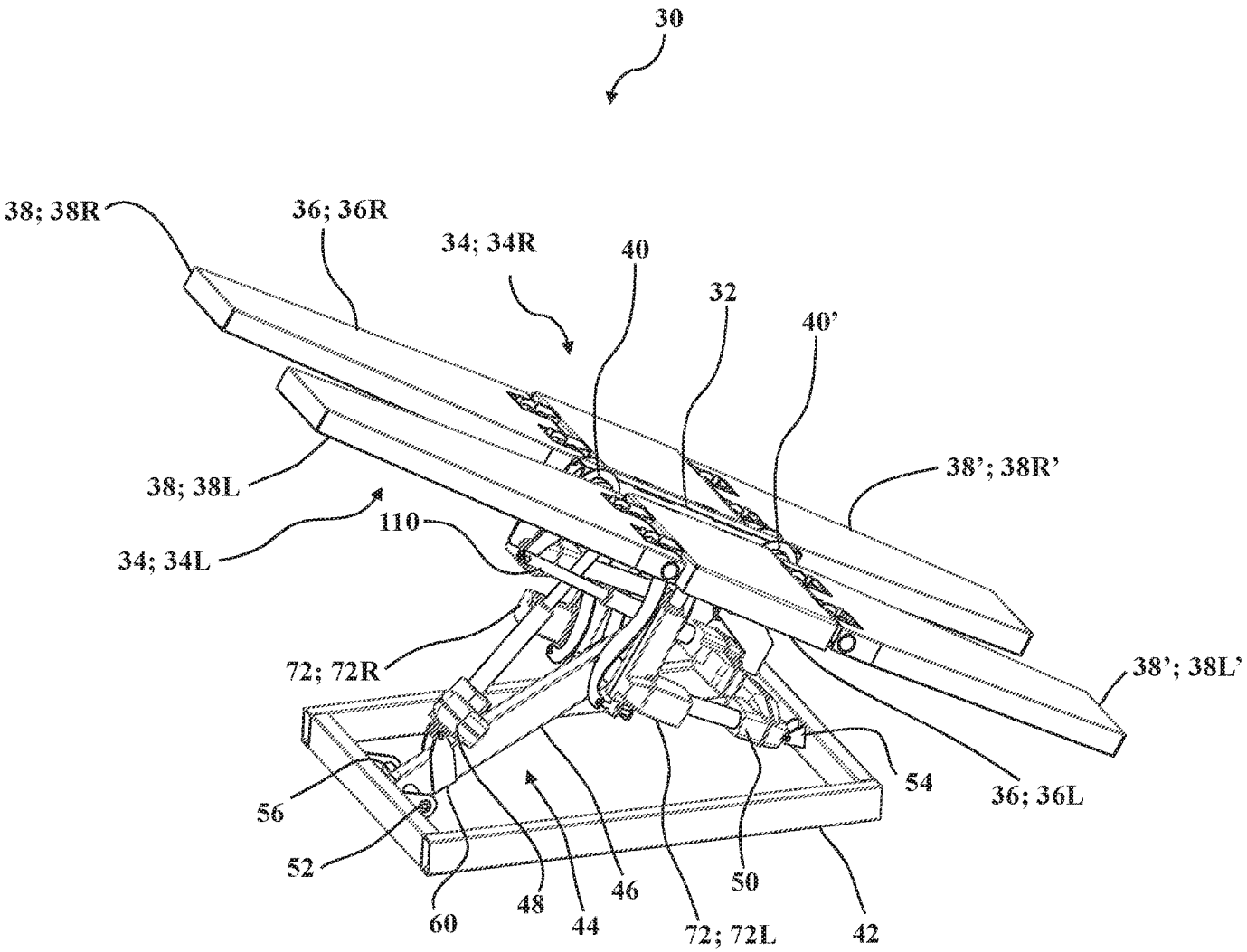
FIG. 10 is a perspective view of the patient support apparatus of FIG. 1 shown in a Trendelenburg position.

Referring now to FIGS. 9 and 10, the patient support apparatus 30 is shown with the support frame 32 tilted relative to the base 42. Specifically, in FIG. 9, the patient support decks 34 are shown arranged in a reverse Trendelenburg position. Similarly, in FIG. 10, the patient support decks 34 are shown arranged in a Trendelenburg position. The arrangement of the intermediate assembly 44 allows movement into these positions by articulating the support frame 32 relative to the base 42 by way of the first lift actuator 48 and the second lift actuator 50, as noted above.

Figure 11A:
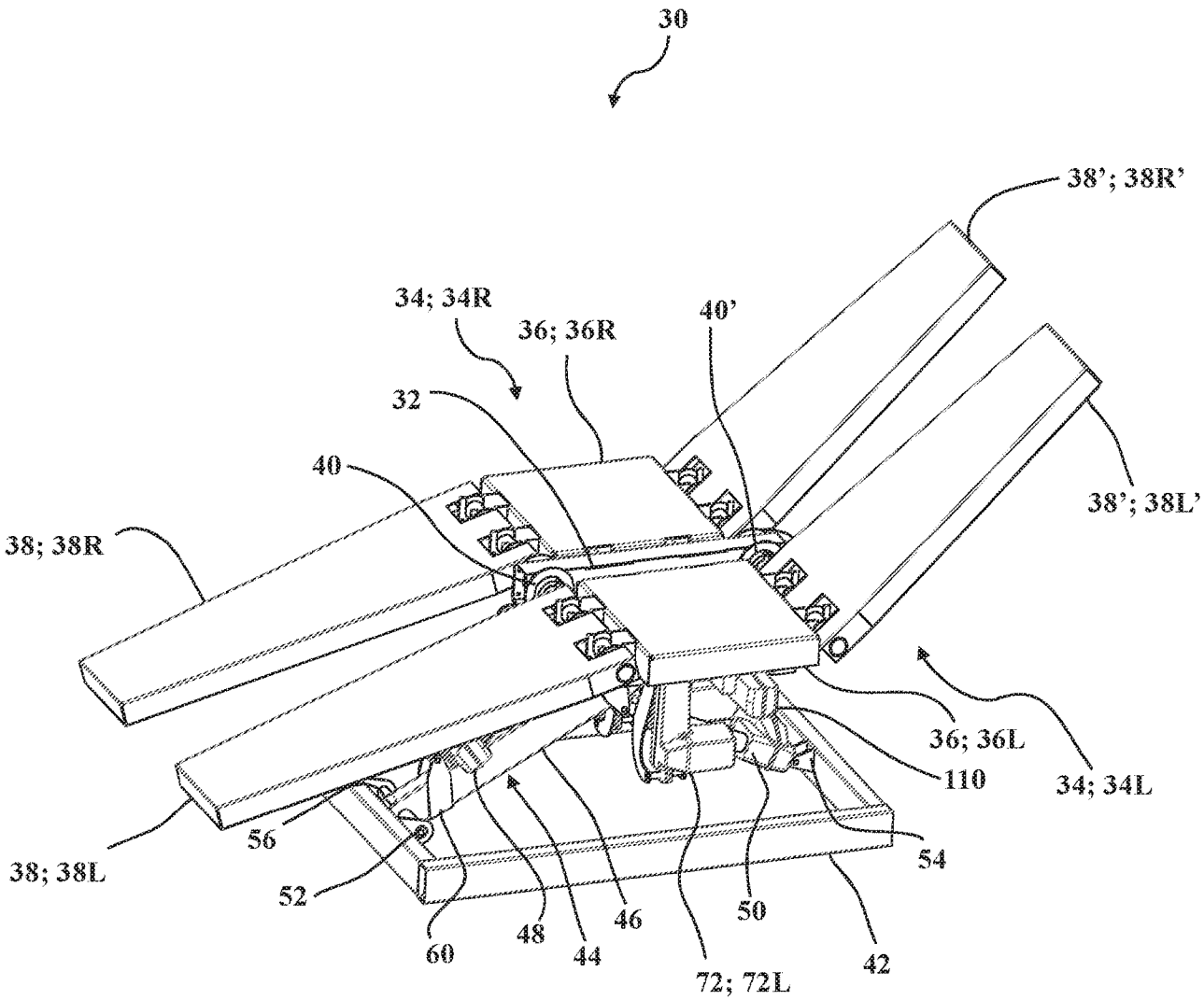
FIG. 11A is a perspective view of the patient support apparatus of FIG. 1 shown in a chair position.
Figure 11B:
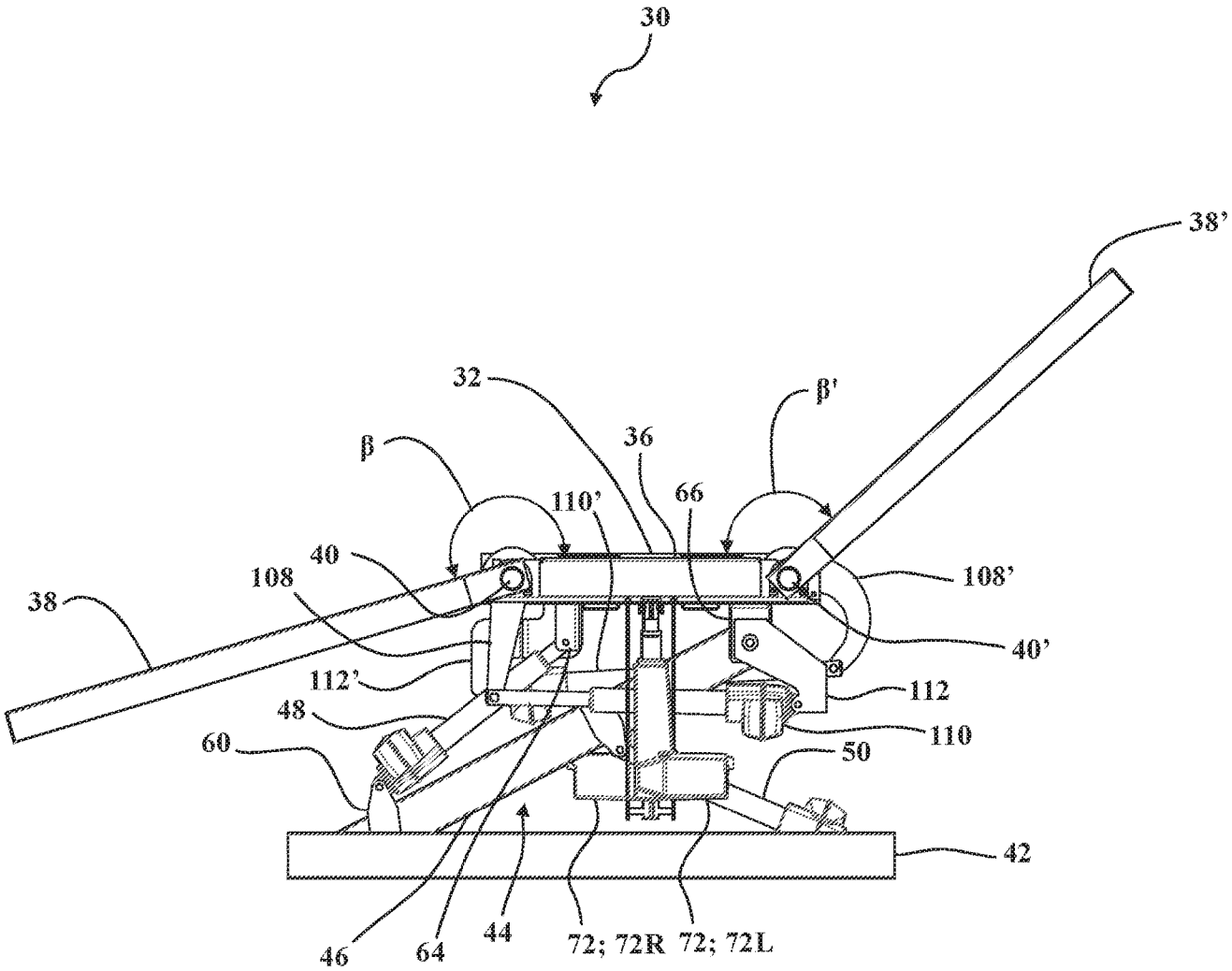
FIG. 11B is a right-side view of the patient support apparatus in the chair position as depicted in FIG. 11A.

Referring now to FIGS. 11A and 11B, the patient support apparatus 30 is shown in a chair position for supporting the patient in a seated position. Here, the patient support apparatus 30 is moved into the illustrated chair position by articulating the first auxiliary sections 38L, 38R such that the first common angle β is greater than 180 degrees, and by articulating the second auxiliary sections 38L', 38R' such that the second common angle β' is less than 180 degrees. It will be appreciated that other positions are contemplated with the auxiliary sections 38, 38' tilted at greater or smaller angles so as to arrange the patient support apparatus 30 in other configurations. For example, the first auxiliary sections 38L, 38R may be articulated at a first common angle β that is less than 180 degrees while the second auxiliary sections 38L', 38R' may be articulated at a second common angle β' that is approximately equal to 180 degrees. Similarly, the first auxiliary sections 38L, 38R may be articulated at a first common angle β that is greater than 180 degrees while the second auxiliary sections 38L', 38R' may be articulated at a second common angle β' that is approximately equal to 180 degrees. In this position the patient's feet are elevated, which may be useful in the detection of sepsis.

Referring now to FIGS. 12A and 12B, the patient support apparatus 30 is shown with the support decks 34 articulated in a cradle position such that the tilt angles γL, γR are both less than 180 degrees. Here, in the cradle position, the support decks 34 are arranged so as to cradle the patient by altering contact points with the patient's body. Here, the advantageous arrangement and configuration of the auxiliary sections 38, 38' described above allows the support decks 34 to be positioned in this cradle position. By adjusting the tilt angles γL, γR the contact points may be altered to adjust a depth of immersion of the patient on the patient support apparatus 30. Adjusting the contact points may further relieve pressure ulcers on patients. Adjustment of the tilt angles γL, γR may be periodically performed according to a prescribed routine and may be automated or manual. Further, the tilt angles γL, γR may be adjusted downward such that the patient's chest is opened for improved respiration. Specifically, the tapered profile of the auxiliary sections 38, 38' allows broad articulation of the auxiliary sections 38, 38' between a broad range of first and second common angles β, β' in cooperation with articulation of the seat sections 36L, 36R between a broad range of tilt angles γL, γR. For example, when either of the first auxiliary sections 38 or the second auxiliary sections 38' are raised, such as by a common angle β, β' of thirty degrees or more the auxiliary sections 38, 38' can also be tilted toward or away from each other without interference.

Referring now to FIGS. 13A-13C, the patient support apparatus 30 is shown with the support decks 34 arranged in different longitudinal support configurations which may advantageously be utilized so as to roll the patient's body over on the patient support apparatus 30, or so as to transfer an immobilized or unresponsive patient to a different patient support apparatus (not shown). Specifically, in FIG. 13A the patient support apparatus 30 is shown in a first longitudinal support configuration with the left support deck 34L articulated to a left tilt angle γL of less than 180 degrees and with the right support deck 34R articulated to a right tilt angle γR of approximately 180 degrees. Here, the patient's body can be positioned so as to initiate rolling the patient from their back to their side, as well as aiding ingress and egress. In FIG. 13B, the patient support apparatus 30 is shown in a second longitudinal support configuration with the right support deck 34R articulated to a right tilt angle γR of greater than 180 degrees and with the left support deck 34L articulated to a left tilt angle γL of approximately 180 degrees. Here, the patient's body can be positioned so as to initiate rolling the patient from their side to their front, as well as aiding ingress and egress. In FIG. 13C, the patient support apparatus 30 is shown in a third longitudinal support configuration with the left support deck 34L articulated to a left tilt angle γL of less than 180 degrees and with the right support deck 34R articulated to a right tilt angle γR of greater than 180 degrees. Here, the patient's body can be positioned so as to facilitate transferring the patient to a different patient support apparatus, as well as aiding ingress and egress. It will be appreciated that other positions are contemplated with the left support deck 34L and the right support deck 34R tilted at greater or smaller angles independent of each other so as to arrange the patient support apparatus 30 in other longitudinal support configurations.

Figure 15:
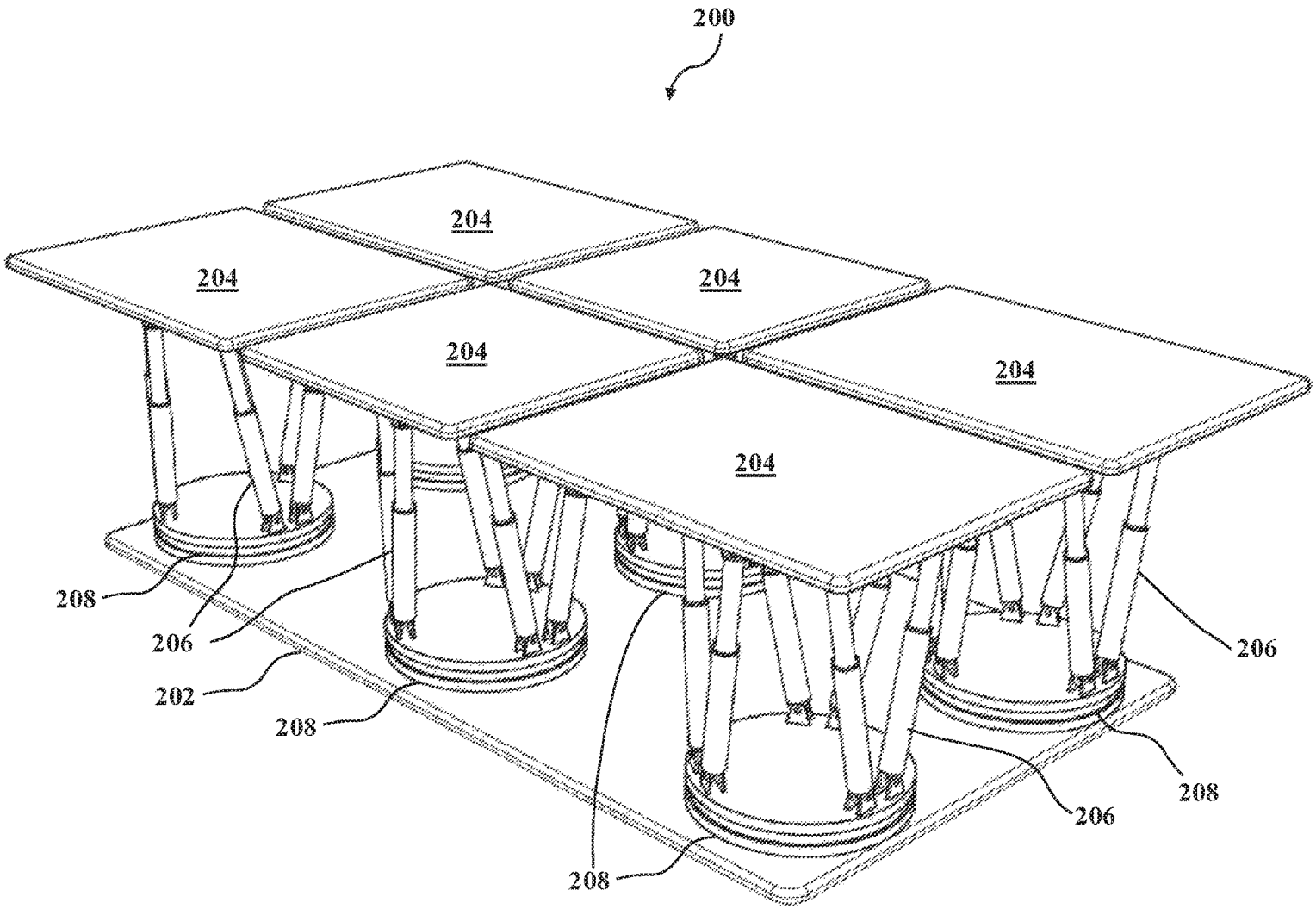
FIG. 15 is a perspective view of another embodiment of a patient support apparatus.

An alternative embodiment of a patient support apparatus 200 is shown in FIG. 15. In this embodiment, the patient support apparatus 200 comprises a base 202 and at least four patient support deck sections 204 each at least partially supporting a patient (not shown). Each of the patient support deck sections 204 comprises actuators 206 interposed in force-translating relationship between the base 202 and each of the at least four patient support deck sections 204. The patient support apparatus 200 comprises a controller 122', similar to the controller 122 as previously described in the embodiment depicted in FIGS. 1-14. Here too, the controller 122' is disposed in communication with each of the actuators 206 to control the position of each of the at least four patient support deck sections 204 in six degrees of freedom. In the representative embodiment illustrated in FIG. 15, a total of six actuators 206 are coupled to each patient support deck section 204 to control and constrain six degrees of freedom of the patient support deck sections 204. Those having ordinary skill in the art will appreciate that the patient support apparatus 200 may comprise more than four patient support deck sections 204. By way of non-limiting example, the patient support apparatus 200 may comprise six patient support deck sections 204 in a two-by-three arrangement, nine patient support deck sections 204 in a three-by-three arrangement, thirty-six patient support deck sections 204 in a six-by-six arrangement, etc. The patient support deck sections 204 may be any suitable shape such as, square, tapered, circular, polygonal, etc.

Each of the at least four patient support deck sections 204 may further comprise a rotary actuator 208 interposed between the patient support deck sections 204 and the base 202. The rotary actuator 208 may be configured to independently rotate each of the patient support deck sections 204 and the respective actuators 206 relative to the base 202.

In this embodiment, the controller 122' is configured to control each actuator 204, as well as the rotary actuators 208, independently to effect movement of each patient support deck section 204. For example, the controller 122' may be configured to raise or lower all of the patient support deck sections 204 simultaneously to raise or lower the patient. Alternatively, the controller 122' may be configured to raise and tilt two of the patient support deck sections 204 and lower and tilt the other two patient support deck sections 204 in order to position the patient in a Trendelenburg position or a reverse Trendelenburg position. Other positions known in the art such as a patient transfer position, a patient roll position, or a chair position are also contemplated. Moreover, the patient support deck sections 204 may be simultaneously moved in distinct directions. For example, the patient support deck sections 204 may effectuate a wave motion. The wave motion may be similar to a sinusoidal wave or a triangle wave. The wave motion may provide therapeutic care to the patient or reduce pressure ulcers.

Each patient support deck section 204 may be controlled individually if so desired. For example, one of the patient support deck sections 204 may be lowered while the others are raised to allow access to the underside of the patient for cleaning or other functions.

In another embodiment, it is further contemplated that the patient support decks 34L, 34R as shown in FIGS. 1-13C may be arranged in conjunction with the patient support deck sections 204 of FIG. 15.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A patient support apparatus for supporting a patient, comprising:

a support frame;

a pair of support decks operatively attached to said support frame with each of said support decks arranged for articulation about a respective longitudinal axis between a plurality of longitudinal support configurations, each of said support decks comprising a seat section and an auxiliary section operatively attached to said seat section for articulation transverse to said respective longitudinal axis;

a joint assembly coupled to said support frame and to each of said support decks with said joint assembly arranged to concurrently position said auxiliary sections at a common angle relative to said respective seat sections independent of articulation of said support decks between said longitudinal support configurations, said joint assembly comprising a hub rotatably supported by said support frame, and a pair of links each operatively attached to one of said support decks and also to said hub with said links configured for concurrent rotation with said hub; and a single, auxiliary actuator interposed in force-translating relationship between said support frame and said joint assembly with said auxiliary actuator configured to simultaneously adjust said common angle of said auxiliary sections relative to said respective seat sections.

2. The patient support apparatus as set forth in claim 1, wherein said joint assembly further comprises a crank arm coupled to said hub for concurrent rotation with said hub.

3. The patient support apparatus as set forth in claim 1, wherein said auxiliary actuator is interposed in force-translating relationship between said support frame and said hub with said auxiliary actuator configured to rotate said hub to adjust said common angle of said auxiliary sections relative to said respective seat sections.

4. The patient support apparatus as set forth in claim 1, wherein said hub and said links of said joint assembly define a pair of swivel joints.

5. The patient support apparatus as set forth in claim 4, wherein said swivel joints each comprise a socket and a ball supported in said socket, with one of said socket and said ball coupled to said hub and the other of said socket and said ball coupled to one of said links.

6. The patient support apparatus as set forth in claim 5, wherein each of said swivel joints further comprises a trunnion coupled to one of said socket and said ball, and wherein the other of said socket and said ball defines a slot therein configured to receive said trunnion, said slot and said trunnion cooperating so as to limit rotation.

7. The patient support apparatus as set forth in claim 1, wherein said pair of support decks are further defined as a left support deck and a right support deck, wherein said auxiliary sections are further defined as first auxiliary sections, and wherein each of said support decks further comprises a second auxiliary section operatively attached to said seat section for articulation transverse to said respective longitudinal axis.

8. The patient support apparatus as set forth in claim 7, wherein said joint assembly is further defined as a first joint assembly coupled to said support frame and to each of said support decks with said first joint assembly arranged to concurrently position said first auxiliary sections at a first common angle relative to said respective seat sections independent of movement of said support decks between said longitudinal support configurations; and further comprising a second joint assembly coupled to said support frame and to each of said support decks with said second joint assembly arranged to concurrently position said second auxiliary sections at a second common angle relative to said respective seat sections independent of movement of said support decks between said longitudinal support configurations.

9. The patient support apparatus as set forth in claim 8, further comprising a second auxiliary actuator interposed in force-translating relationship between said support frame and said second joint assembly with said second auxiliary actuator configured to adjust said second common angle of said second auxiliary sections relative to said respective seat sections.

10. The patient support apparatus as set forth in claim 9, further comprising a controller disposed in communication with said actuators with said controller configured to selectively and independently drive said actuators to effect independent movement of said first auxiliary sections and said second auxiliary sections.

11. The patient support apparatus as set forth in claim 1, further comprising a pair of deck actuators each interposed in force-translating relationship between said support frame and one of said support decks with said deck actuators configured to independently move said support decks between said plurality of longitudinal support configurations.

12. The patient support apparatus as set forth in claim 11, further comprising a controller disposed in communication with each of said deck actuators with said controller configured to selectively and independently drive said deck actuators so as to effect coordinated movement of said support decks.

13. The patient support apparatus as set forth in claim 1, further comprising:

a base;

a first lift actuator interposed in force-translating relationship between said base and said support frame to move said support frame; and a second lift actuator interposed in force-translating relationship between said base and said support frame and in cooperation with said first lift actuator to effect articulated movement of said support frame relative to said base.

14. The patient support apparatus as set forth in claim 13, further comprising a controller disposed in communication with said first lift actuator and with said second lift actuator, with said controller configured to selectively and independently drive said first lift actuator and said second lift actuator to effect articulated movement of said support frame relative to said base.

15. The patient support apparatus as set forth in claim 14, wherein said controller is further configured to drive said first lift actuator and said second lift actuator to effect vertical movement of said support frame relative to said base.

16. The patient support apparatus as set forth in claim 14, wherein said controller is further configured to drive said first lift actuator and said second lift actuator to effect pivoting movement of said support frame relative to said base.

17. The patient support apparatus as set forth in claim 1, wherein a tilt angle is defined between each of said seat sections and said support frame, with said longitudinal support configurations corresponding to a value of said tilt angle; and further comprising a pair of deck actuators each interposed in force-translating relationship between said support frame and one of said support decks with said deck actuators configured to independently adjust each of said tilt angles to define a plurality of patient support positions.

18. The patient support apparatus as set forth in claim 1, wherein each of said auxiliary sections has a proximal end and a distal end with a tapered profile extending from said proximal end to said distal end.

19. The patient support apparatus as set forth in claim 18, wherein said auxiliary sections each define first width adjacent to said proximal end and a second width adjacent to said distal end; and wherein a ratio defined between said first width and said second width is at least 1.5:1.

20. The patient support apparatus as set forth in claim 1, wherein said joint assembly is arranged to provide two degrees of freedom of movement for each of said auxiliary sections, including articulation about said respective longitudinal axis and articulation transverse to said respective longitudinal axis.

* * * * *